US011387593B2

(12) United States Patent
Park et al.

(10) Patent No.: US 11,387,593 B2
(45) Date of Patent: Jul. 12, 2022

(54) HIGH VOLTAGE CONNECTOR ASSEMBLY AND MOTOR-OPERATED COMPRESSOR INCLUDING THE SAME

(71) Applicant: LG ELECTRONICS INC., Seoul (KR)

(72) Inventors: Chanjae Park, Seoul (KR); Suchul Kim, Seoul (KR); Ikseo Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 10 days.

(21) Appl. No.: 16/985,479

(22) Filed: Aug. 5, 2020

(65) Prior Publication Data

US 2022/0045455 A1 Feb. 10, 2022

(51) Int. Cl.

| | |
|---|---|
| ***H01R 13/52*** | (2006.01) |
| ***H01R 13/629*** | (2006.01) |
| ***H01R 13/53*** | (2006.01) |
| ***H01R 13/533*** | (2006.01) |
| ***H01R 13/518*** | (2006.01) |

(Continued)

(52) U.S. Cl.

CPC ..... *H01R 13/521* (2013.01); *F04C 23/008* (2013.01); *H01R 13/518* (2013.01); *H01R 13/53* (2013.01); *H01R 13/533* (2013.01); *H01R 13/629* (2013.01); *H01R 13/6592* (2013.01); *F04C 2240/803* (2013.01); *F25B 2400/07* (2013.01)

(58) Field of Classification Search

CPC .... H01R 13/6581–6597; H01R 13/521; H01R 13/629; H01R 13/53; H01R 13/533; H01R 13/518; F04C 23/008; F04C 2240/803; F25B 2400/07

USPC ..... 439/607.01–607.58

See application file for complete search history.

(56) References Cited

U.S. PATENT DOCUMENTS 4,640,985 A * 2/1987 Martin ..... H01F 27/02 174/138 F 5,244,415 A * 9/1993 Marsilio ..... H01R 9/032 439/607.47

(Continued)

FOREIGN PATENT DOCUMENTS

KR 10-1078657 B1 11/2011

KR 10-1693388 B1 1/2017

*Primary Examiner* — Gary F Paumen

(74) *Attorney, Agent, or Firm* — Birch, Stewart, Kolasch & Birch, LLP

(57) ABSTRACT

A high-voltage connector assembly and a motor-operated compressor including the same are disclosed. The high-voltage connector assembly according to embodiments disclosed herein may include a cover defining an outer appearance and a shielding plate designed to shield an electrical noise signal. The cover and the shielding plate may be integrally formed by a double shot molding or insert injection molding. Accordingly, manufacturing time and costs of the cover and the shielding plate may be reduced. In addition, the cover and the shielding plate may be coupled to each other in a more stable manner. Further an outer circumferential portion of the shielding plate may have a higher roughness than the cover. Alternatively, the outer circumferential portion of the shielding plate may be provided with a plate protrusion or an uneven portion. Accordingly, a contact area between the shielding plate and the cover may be increased.

14 Claims, 11 Drawing Sheets

(51) Int. Cl.
*F04C 23/00* (2006.01)
*H01R 13/6592* (2011.01)

(56) References Cited

U.S. PATENT DOCUMENTS

| | | | | |
|---|---|---|---|---|
| 5,906,513 | A * | 5/1999 | Peterson | H01R 13/65912 439/607.58 |
| 8,574,007 | B2 * | 11/2013 | Smith | H01R 13/6592 439/607.5 |
| 10,253,763 | B2 * | 4/2019 | Nakagami | F04B 39/121 |
| 10,544,805 | B2 * | 1/2020 | Ambo | F04B 35/04 |
| 10,879,773 | B2 * | 12/2020 | Ambo | H03H 7/0115 |
| 2003/0182956 | A1 * | 10/2003 | Kurita | H02M 1/4225 62/228.1 |
| 2005/0100456 | A1 * | 5/2005 | Osaka | F04B 39/0055 417/415 |
| 2012/0248903 | A1 * | 10/2012 | Cullen | H02K 9/19 310/53 |
| 2013/0323097 | A1 * | 12/2013 | Fukasaku | F04C 18/0215 417/410.1 |
| 2014/0134017 | A1 * | 5/2014 | Yano | F04B 39/121 417/410.1 |
| 2015/0295362 | A1 * | 10/2015 | Tziviskos | H01R 13/6585 439/607.01 |
| 2019/0267890 | A1 * | 8/2019 | Werker | H02M 1/126 |

* cited by examiner

HIGH VOLTAGE CONNECTOR ASSEMBLY AND MOTOR-OPERATED COMPRESSOR INCLUDING THE SAME

BACKGROUND

1. Technical Field

The present disclosure relates to a high-voltage connector assembly and a motor-operated compressor including the same. More particularly, the present disclosure relates to a high-voltage connector assembly having a structure that easily connects a high-voltage connector and a housing, and prevents electric current leakage and water leakage through the high-voltage connector, and a motor-operated compressor including the same.

2. Description of the Related Art

A compressor designed to compress a refrigerant in an air conditioning system for vehicles has been developed in various forms. Recently, as automobile components are becoming electrical, a motor-operated compressor driven by electricity has been actively developed.

The motor-operated compressor mainly employs a scroll compression method suitable for a high compression ratio operation among various compression methods. Such a scroll type motor-operated compressor (hereinafter, referred to as "motor-operated compressor"), includes a motor unit, a compression unit, and a rotating shaft that connects the motor unit and the compression unit.

In detail, the motor unit configured as a rotary motor is installed in a hermetic casing, and the compression unit configured by a fixed scroll and an orbiting scroll is disposed at one side of the motor unit. The rotating shaft is configured such that a rotational force of the motor unit is transferred to the compression unit.

The rotary motor is configured to receive power and a control signal from an external power source, such as a battery, and a controller. To this end, the rotary motor is electrically connected to the external power source and the controller (hereinafter referred to as "power source, etc."). The electric connection can be enabled by an electrically conductive member such as a conducting wire.

When the motor-operated compressor is in operation, vibration may be generated in the motor-operated compressor due to rotation of the rotary motor and an orbiting scroll. When connected by a conducting wire, or the like, electric connection between the motor-operated compressor and the power source, etc. may be arbitrarily disconnected by the vibration.

Thus, a connector is generally used to connect the motor-operated compressor and the power source, etc.

A connector 1000 of a motor-operated compressor according to the related art is illustrated in FIGS. 1 and 2.

The connector 1000 according to the related art is configured such that an inverter device and a rotary motor accommodated in the motor-operated compressor are eclectically connected to an external power source, etc.

The connector 1000 includes a cover 1100 and a connector 1200 made of aluminum (Al). The connector 1200 is configured to shield noise of a filter unit (not shown) to which a conducting wire 1800 is electrically connected.

The connector 1200 is inserted into a space formed inside the cover 1100. In detail, the connector 1200 is insertedly coupled to the cover 1100 through an insertion portion 1130 formed as an opening at one side of the cover 1100.

Once the connector 1200 is inserted, a plate 1300, a sealing part (or unit) 1400, and a conducting wire coupling portion 1500 are sequentially inserted into the space. Then, a bracket 1600 is coupled to the cover 1100 by a bolt 1700.

To this end, a bolt coupling groove 1120 is provided on the cover 1100 in a recessed manner. In addition, a bolt coupling hole 1620 is formed through a corresponding position of the bracket 1600.

When this process is completed, the connector 1000 is coupled to the motor-operated compressor. In detail, a separate coupling member (not shown) is coupled to each of coupling holes 1110 formed through the cover 1100, respectively, so that the connector 1000 is coupled to the motor-operated compressor.

Thereafter, the conducting wire 1800 is inserted into the connector 1000. The conducting wire 1800 is electrically connected to the connector 1200 by passing through a conducting wire penetrating portion 1610 and a through hole formed on the plate 1300.

As such, the connector 1000 according to the related art requires a large number of members for manufacturing. Thus, a unit cost of production, time, etc. for manufacturing each of the members are increased. Further, as many members are provided, weight of the connector 1000 is increased accordingly.

In addition, if the members are not tightly (or hermetically) assembled to each other, electric current leakage may occur through a gap between the members. When the motor-operated compressor is provided in a vehicle or the like, moisture may be introduced through the gap, which may cause a malfunction of the motor-operated compressor.

Furthermore, the connector 1000 is connected to the motor-operated compressor that accommodates a rotary member therein. Accordingly, various members provided at the connector 1000 may be damaged or decoupled (or separated) by vibration generated in the motor-operated compressor.

A compressor assembly and an electric connector for the compressor assembly are disclosed in Korean Patent Laid-Open Publication No. 10-1078657, which is hereby incorporated by reference. In detail, an outer connector block assembly and an inner connector block assembly are assembled to each other using a conductor pin, so as to prevent end fittings assembled to a connector block from being disassembled (or detached).

However, the electric connector having such a structure does not provide solutions for reducing the number of parts of a connector, maintaining airtightness (or hermetically sealed state) between parts coupled to each other, etc.

A connector for a motor-operated compressor is disclosed in Korean Patent Laid-Open Publication No. 10-1693388, which is hereby incorporated by reference. More particularly, a connector for a motor-operated compressor having a structure that can protect users from a potential electrical shock is disclosed. In order for this, a residual voltage is discharged on a terminal of the connector of the compressor simultaneously when a power supply connector is disconnected from the connector of the compressor.

However, the connector having such a structure has a limitation in that there is no consideration for reducing the number of parts of a connector and maintaining airtightness between parts coupled to each other.

Furthermore, in the above-mentioned Patent Documents, a method for maintaining a hermetically sealed state between members coupled to each other and a method for preventing damage caused by vibration generated when a motor-compressor is driven.

RELATED ART DOCUMENT

Patent Document

Korea Patent Laid-Open Publication No. 10-1078657 (Published on Nov. 1, 2011)

Korea Patent Laid-Open Publication No. 10-1693388 (Published on Jan. 5, 2017)

SUMMARY

Embodiments herein provide a high-voltage connector assembly having a structure that can solve the above-mentioned problems, and a motor-operated compressor including the high-voltage connector assembly.

One aspect of the present disclosure is to provide a high-voltage connector assembly and a motor-operated compressor including the same, capable of reducing the number of members constituting the high-voltage connector assembly used for electrically connecting the motor-operated compressor to an external power source and controller.

Another aspect of the present disclosure is to provide a high-voltage connector assembly and a motor-operated compressor including the same, capable of reducing manufacturing time and costs.

Still another aspect of the present disclosure is to provide a high-voltage connector assembly and a motor-operated compressor including the same, capable of enabling members constituting the high-voltage connector assembly to be coupled to one another in an easier manner.

Still another aspect of the present disclosure is to provide a high-voltage connector assembly and a motor-operated compressor including the same, capable of enhancing durability against vibration generated when a motor-operated compressor is in operation.

Still another aspect of the present disclosure is to provide a high-voltage connector assembly and a motor-operated compressor including the same, capable of effectively shielding electromagnetic noise generated when a motor-operated compressor is in operation.

Still another aspect of the present disclosure is to provide a high-voltage connector assembly and a motor-operated compressor including the same, capable of increasing a coupling force between a cover and a shielding plate.

Still another aspect of the present disclosure is to provide a high-voltage connector assembly and a motor-operated compressor including the same, capable of minimizing a gap between a cover and a shielding plate generated due to a difference in thermal expansivity between the cover and the shielding plate.

Embodiments disclosed herein provide a high-voltage connector assembly that may include a cover having an opening portion formed at one side thereof and provided therein with a space portion communicating with the opening portion, and a shielding plate disposed inside the cover so as to cover the opening portion and configured to shield noise generated in an Electromagnetic Compatibility (EMC) filter. The cover and the shielding plate may be integrally formed with each other.

The cover may be made of an insulating material, and the shielding plate may be made of a conductive material. The cover and the shielding plate may be formed by double shot molding.

Embodiments disclosed may further provide a high-voltage connector assembly that may include a holder coupled to the cover to hermetically seal an inside of the cover. The holder may be detachably coupled to another side of the cover.

In addition, the another side of the cover may be provided with a boss portion protruding by a predetermined distance. The boss portion may be provided therein with a cable insertion portion communicating with the space portion and configured to be opened so as to allow a high-voltage cable to be inserted. The holder may be coupled to the cover so as to cover the cable insertion portion.

The cover and the holder may be snap-fitted to each other.

In addition, the boss portion may include a holder coupling protrusion that protrudes from one outer surface of the boss portion by a predetermined distance. The holder may include a cover coupling portion protruding in a lengthwise direction by a predetermined distance, and a cover insertion hole provided in the cover coupling portion and formed though the cover coupling portion at a predetermined angle with respect to the lengthwise direction of the cover coupling portion. When the holder is coupled to the cover, the holder coupling protrusion may be inserted into the cover insertion hole.

The cover and the holder may be provided therebetween with a support plate located adjacent to the cover and configured to support a high-voltage cable inserted into the cover, and a sealing part located adjacent to the support plate and configured to surround the inserted high-voltage cable. The cover, the support plate, the sealing part, and the holder may be sequentially disposed.

The shielding plate may include a plate outer circumferential portion that comes in contact with an inner circumferential portion of the cover and defines an outer circumference of the shielding plate. The plate outer circumferential portion may have a higher roughness than the inner circumferential portion of the cover.

Further, the shielding plate may include a plate outer circumferential portion that comes in contact with an inner circumferential portion of the cover and defines an outer circumference of the shielding plate. The plate outer circumferential portion may be provided with a plate protrusion protruding from the plate outer circumferential portion so as to increase a surface area.

A plurality of plate protrusions may be provided to be spaced apart from one another by a predetermined distance along the plate outer circumferential portion.

In addition, the shielding plate may include a plate outer circumferential portion that comes in contact with an inner circumferential portion of the cover and defines an outer circumference of the shielding plate. A surface of the outer circumferential portion may be provided with a plurality of uneven portions so as to increase a surface area.

Embodiments disclosed herein also provide a motor-operated compressor that may include a main housing accommodating a motor and a compression unit therein, a front housing communicating with the main housing and having an inlet port formed through one side thereof so that a refrigerant is introduced into the main housing, and a high-voltage connector assembly coupled to the front housing and configured to support a high-voltage cable electrically connected to an external controller. The high-voltage connector assembly may include a cover having an opening portion formed at one side thereof and provided therein with a space portion communicating with the opening portion, and a shielding plate disposed inside the cover so as to cover the opening portion and configured to shield noise generated in an Electromagnetic Compatibility (EMC) filter. The cover and the shielding plate may be integrally formed with each other.

In addition, the high-voltage connector assembly of the motor-operated compressor may include a holder coupled to the cover and configured to hermetically seal an inside of the cover. The holder may be detachably coupled to another side of the cover.

The shielding plate may include a plate outer circumferential portion that comes in contact with an inner circumferential portion of the cover and defines an outer circumference of the shielding plate. The plate outer circumferential portion may be provided with at least one of a plate protrusion protruding therefrom, and a plurality of uneven portions.

The embodiments of the present disclosure may provide the following benefits.

First, a cover and a shielding plate are integrally formed by double shot molding. In addition, the cover and other components may be coupled to each other by a holder.

Accordingly, a cover and a shielding connector are not necessarily provided separately. In addition, a separate (or additional) coupling member for coupling the cover and the other components is not required. As a result, the number of members of a high-voltage connector assembly may be reduced.

Further, as the number of members of the high-voltage connector assembly is reduced, a unit cost of production for each of the members may be reduced.

Furthermore, as the number of members is reduced, the number of members to be coupled to each other is reduced accordingly, thereby decreasing a time taken to manufacture the high-voltage connector assembly.

In addition, the cover and the shielding plate may be integrally formed in a manner of double shot molding. Also, the cover and the other members are coupled by the holder. The holder and the cover may be coupled to each other in a snap-fit manner.

Accordingly, the cover and the shielding plate are not necessarily coupled to each other, separately. In addition, a separate coupling member is not required to couple the holder and the cover to each other. This makes easier for the cover and shielding plate, and the cover and the holder to be coupled to each other, respectively.

Also, as described above, the number of members of the high-voltage connector assembly is reduced. Accordingly, a contact area between members may be reduced. In addition, a clearance that may be generated between members may be reduced. Thus, durability against vibration may be enhanced.

Further, the shielding plate designed to shield electromagnetic noise is formed integrally with the cover. Accordingly, even if vibration is generated by operating a motor-operated compressor, the shielding plate is not moved or swayed inside the cover. Thus, the shielding plate can be located at an optimal position for shielding electromagnetic noise.

This allows electromagnetic noise generated when the motor-operated compressor is in operation may be effectively shielded.

In addition, in one embodiment, an outer circumference of the shielding plate may have a relatively high roughness. Thus, a contacting force between the shielding plate and the cover can be increased. At the same time, a frictional force between the shielding plate and the cover may be increased.

Thus, a coupling force between the shielding plate and the cover may be increased. Accordingly, even if the cover and the shielding plate are thermally expanded to different degrees by heat produced when the motor-operated compressor is driven, a clearance may be minimized.

In another embodiment, a plate protrusion may protrude from the outer circumference of the shielding plate that comes in contact with the cover. The plate protrusion may be configured to increase a contact area between the shielding plate and the cover. In addition, a plurality of plate protrusions may be provided to be spaced apart from one another by a predetermined distance, thereby forming a space between neighboring plate protrusions.

Accordingly, a coupling force between the shielding plate and the cover may be increased. Thus, even if the cover and the shielding plate are thermally expanded to different degrees by heat produced when the motor-operated compressor is in operation, a clearance may be minimized.

Further, in another embodiment, an uneven portion may be formed on the outer circumference of the shielding plate that comes in contact with the cover. The uneven portion may be configured to increase a contact area between the shielding plate and the cover.

Accordingly, a coupling force between the shielding plate and the cover may be increased. Thus, even if the cover and the shielding plate are thermally expanded to different degrees by heat produced when the motor-operated compressor is in operation, a clearance may be minimized.

DETAILED DESCRIPTION OF THE EMBODIMENTS

Figure 1:
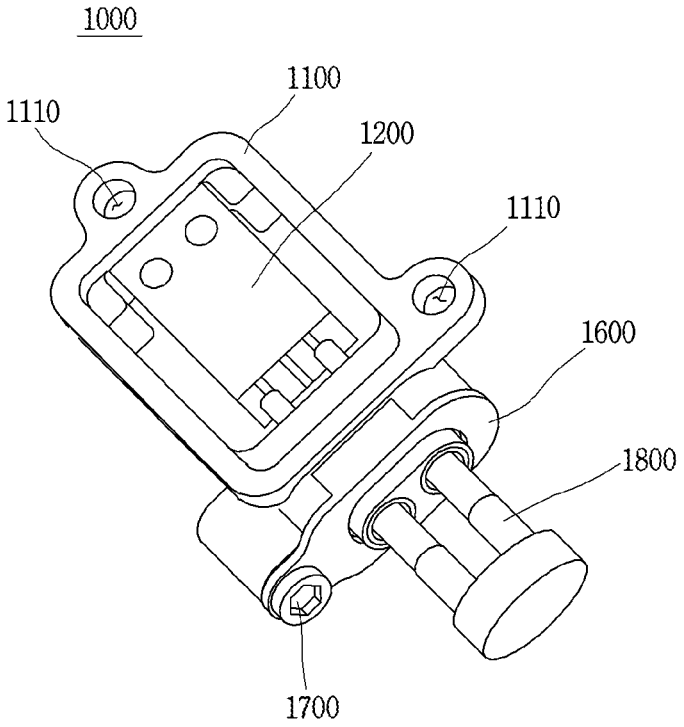
FIG. 1 is a perspective view of a high-voltage connector according to the related art.
Figure 2:
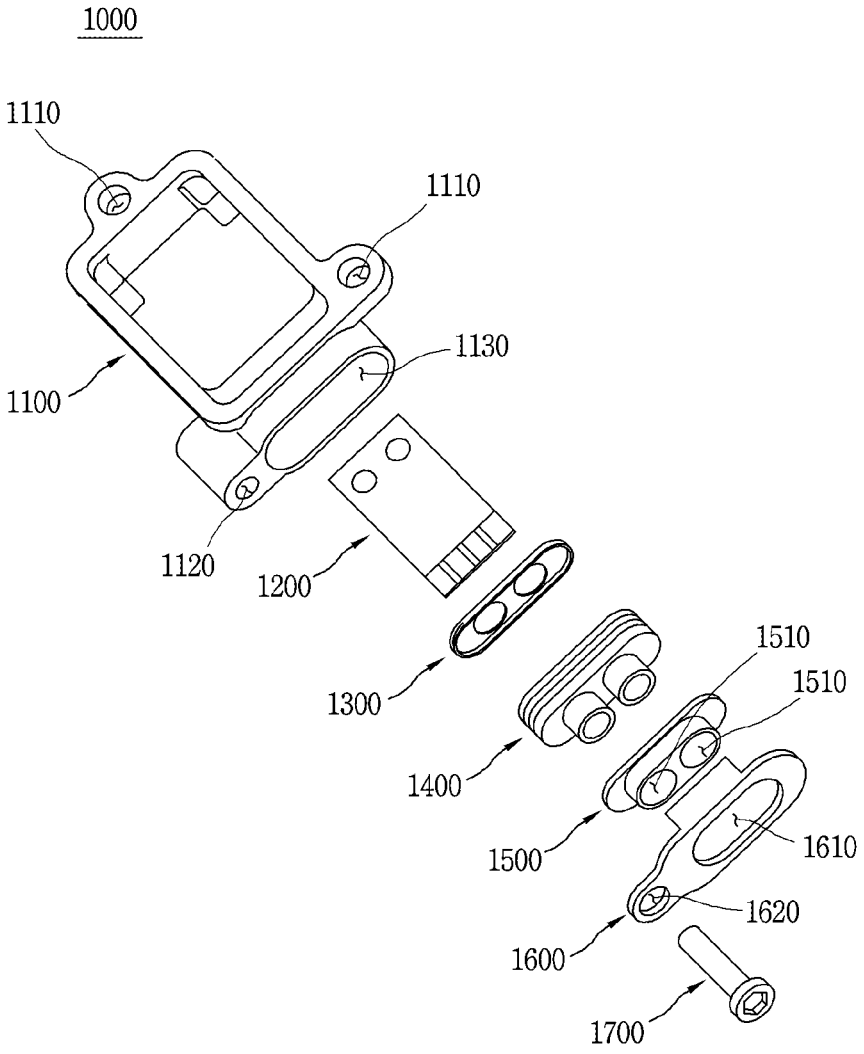
FIG. 2 is an exploded perspective view of the high-voltage connector of FIG. 1.

Description will now be given for a motor-operated compressor according to embodiments disclosed herein, with reference to the accompanying drawings.

For the sake of brief description with reference to the drawings, the same or equivalent components may be provided with the same or similar reference numbers, and description thereof will not be repeated.

1. Definition of Terms

It will be understood that when an element is referred to as being "connected with" another element, the element can be directly connected with the other element or intervening elements may also be present.

On the contrary, in case where an element is "directly connected" or "directly linked" to another element, it should be understood that any other element is not existed therebetween.

A singular representation may include a plural representation as far as it represents a definitely different meaning from the context.

A term "refrigerant" used in the following description may mean a medium that takes heat away from a low temperature object and transports the heat to a higher temperature object. In one embodiment, the refrigerant may be a carbon dioxide ($CO_2$), R134a, R1234yf, R744, or the like.

In the following description, it is assumed that R134a is used as a refrigerant for a motor-operated compressor 10 according to embodiments described herein, but other refrigerants described above may also be used in the motor-operated compressor 10 according to the embodiments of the present disclosure.

2. Description of Configuration of Motor-Operated Compressor 10 According to Embodiment Referring to FIG. 3, a motor-operated compressor 10 according to an embodiment of the present disclosure may include a main housing 100, a rear housing 200, a front housing 300, and an Electromagnetic Compatibility (EMC) filter 400.

In addition, the motor-operated compressor 10 according to this embodiment may further include a high-voltage connector assembly 500 so as to be electrically connected to an external power source (not shown) and controller (not shown).

Figure 3:
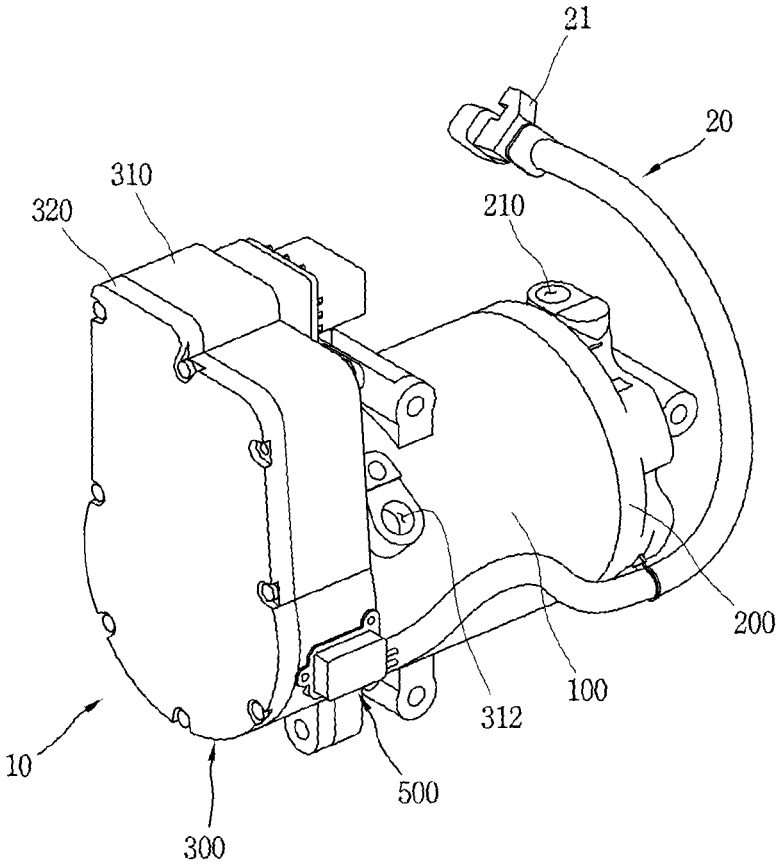
FIG. 3 is a perspective view of a motor-operated compressor according to an embodiment of the present disclosure.

Hereinafter, each of components of the motor-operated compressor 10 according to this embodiment will be described with reference to FIG. 3, but the high-voltage connector assembly 500 will be described in another section.

(1) Description of the Main Housing 100

The main housing 100 may define an outer appearance (or shape) of the motor-operated compressor 10. A predetermined space may be formed inside the main housing 100. Various components for compressing or pressurizing a refrigerant may be accommodated in the space.

For example, although not shown, a compression unit (not shown) for pressurizing a refrigerant, a motor unit (or motor) (not shown) for applying a rotational force to the compression unit (not shown) may be accommodated in the inner space of the main housing 100.

In addition, a rotating shaft (not shown) that transmits the rotational force of the motor unit (not shown) to the compression unit (not shown) may also be accommodated in the inner space of the main housing 100.

A shape of the main housing 100 may differ according to a shape of the space formed therein. In this embodiment, the main housing 100 has a cylindrical shape extending in the lengthwise direction. This is to have a high pressure resistance against a refrigerant compressed in the inner space of the main housing 100.

The rear housing 200 may be located at one side of the main housing 100, for example, at a right side of the main housing 100 in the illustrated embodiment.

The main housing 100 may communicate with the rear housing 200. A refrigerant pressurized in the main housing 100 may be introduced into the rear housing 200. The refrigerant may be discharged to an outside of the motor-operated compressor 10 through an exhaust port 210 provided at the rear housing 200.

The front housing 300 may be located at another side of the main housing 100, for example, a left side, opposite to the rear housing 200, in the illustrated embodiment.

The main housing 100 may communicate with the front housing 300. A refrigerant introduced through an inlet port 312 of the front housing 300 may be introduced into the main housing 100. The refrigerant may be pressurized by the compression unit (not shown) accommodated in the main housing 100.

The main housing 100 may be electrically connected to the front housing 300. Power and a control signal required to drive the motor unit (not shown) are applied by the external power source (not shown) and controller (not shown).

The external power source (not shown) and controller (not shown) may be electrically connected to the high-voltage connector assembly 500, so that power and a control signal are applied to the front housing 300. The power and the control signal applied to the front housing 300 may be transmitted to the main housing 100, allowing the motor unit (not shown) to be driven.

To this end, the main housing 100 may be electrically connected to the front housing 300 by an electrically conductive member (not shown). In one embodiment, the electrically conductive member (not shown) may be implemented as a conducting wire.

(2) Description of the Rear Housing 200

The rear housing 200 may define an outer appearance of the motor-operated compressor 10.

A predetermined space may be formed inside the rear housing 200. A refrigerant discharge passage (not shown) through which a compressed refrigerant is discharged may be provided at the space. In addition, the space may be provided with an oil discharge passage (not shown) through which oil separated from the compressed refrigerant is discharged.

The rear housing 200 may be located at one side of the main housing 100, for example, at the right side of the main housing 100 in the illustrated embodiment.

The rear housing 200 may communicate with the main housing 100. A refrigerant pressurized from the inner space of the main housing 100 may be introduced into the rear housing 200. The refrigerant may be discharged to the outside of the motor-operated compressor 10 after an oil separation process.

The exhaust port 210 may be provided at one side of the rear housing 200. The exhaust port 210 may be configured to provide communication between an inner space of the rear housing 200 and the outside. In one embodiment, the exhaust port 210 may be configured as a through hole.

(3) Description of the Front Housing 300

The front housing 300 may define an outer appearance of the motor-operated compressor 10.

A predetermined space may be formed inside the front housing 300. An inverter device (not shown) that processes power and a control signal applied from the external power source (not shown) and controller (not shown), respectively, may be disposed at the space. Accordingly, the space may be referred to as an "inverter chamber".

The front housing 300 may be located at one side of the main housing 100, for example, the left side, opposite to the rear housing 200, in the illustrated embodiment.

The front housing 300 may communicate with the main housing 100. A refrigerant introduced into the front housing 300 may flow into the main housing 100. The introduced refrigerant may be pressurized by the compression unit (not shown) accommodated in the inner space of the main housing 100.

An inner space of the front housing 300 may be electrically connected to the inner space of the main housing 100. Power and a control signal transmitted to the inverter device (not shown) may be transferred to the motor unit (not shown) accommodated in the main housing 100. In one embodiment, an electrically conductive member (not shown) such as a conducting wire may be provided to allow the electrical connection between the inner space of the front housing 300 and the inner space of the main housing 100.

A partition wall (not shown) may be provided in the inner space of the front housing 300. The partition wall may separate a space in which a refrigerant flows from a space in which the inverter device (not shown) is accommodated.

When the partition wall is provided, a communication hole may be provided at the partition wall. A refrigerant introduced into the inner space of the front housing 300 may flow into the space in which the inverter device is accommodated through the communication hole. In this case, the inverter device may be directly cooled by the refrigerant introduced thereinto.

The front housing 300 may include a first front cover 310, a second front cover 320, a connector coupling portion 330, and a filter accommodating portion 340.

The first front cover 310 may define one side of the front housing 300. The first front cover 310 may be located adjacent to the main housing 100.

The first front cover 310 may be coupled to the main housing 100. A through hole (not shown) may be formed in the first front cover 310, allowing the inner space of the front housing 300 and the inner space of the main housing 100 to communicate with each other.

The first front cover 310 and the second front cover 320 may be coupled to each other. A predetermined space, which may be referred to as 'inverter chamber', is formed between the first front cover 310 and the second front cover 320. The inverter device (not shown) may be accommodated in the space.

The first front cover 310 may include the inlet port 312. The inlet port 312 is a passage through which a refrigerant at the outside flows into the inner space of the front housing 300. In one embodiment, the inlet port 312 may be formed as a through hole.

The second front cover 320 may define another side of the front housing 300. The second front cover 320 may be located at one side of the first front cover 310, which is opposite to the main housing 100. The second front cover 320 may be located at the left side, which is an opposite side of the main housing 100 with respect to the first front cover 310 in the illustrated embodiment.

The second front cover 320 and the first front cover 310 may be coupled to each other. A predetermined space, which may be referred to as 'inverter chamber', is formed between the second front cover 320 and the first front cover 310. The inverter device (not shown) may be accommodated in the space.

The high-voltage connector assembly 500 may be electrically coupled to the connector coupling portion 330. In one embodiment, the high-voltage connector assembly 500 may be coupled to the connector coupling portion 330 by a screw. To this end, the connector coupling portion 330 may be provided with a hollow portion through which the screw is inserted in a penetrating manner.

A high-voltage cable 20 may be electrically connected to the high-voltage connector assembly 500. An external connector 21 may be provided at another side of the high-voltage cable 20. The external connector 21 may be electrically connected to the external power source (not shown) and controller (not shown), respectively.

This configuration may allow the external power source (not shown) and controller (not shown) to be electrically connected to the motor-operated compressor 10.

The connector coupling portion 330 may be located at the first front cover 310. In the illustrated embodiment, on an outer circumference of the first front cover 310, the connector coupling portion 330 is located at a lower side of the inlet port 312. A location (or position) of the connector coupling portion 330 may be changed.

The EMC filter 400 may be inserted into the filter accommodating portion 340. In detail, a filter body portion 420 of the EMC filter 400 may be inserted into the filter accommodating portion 340 (see FIG. 11).

The filter accommodating portion 340 may be defined as a space recessed by a predetermined distance from an outer circumferential surface of the first front cover 310. A shape of the filter accommodating portion 340 may, preferably, be determined according to a shape of the EMC filter 400.

The high-voltage connector assembly 500 may be coupled to an outer side of the high-voltage connector assembly 500 inserted into the filter accommodating portion 340. Accordingly, the EMC filter 400 may be stably accommodated in the filter accommodating portion 340.

(4) Description of the Electromagnetic Compatibility (EMC) Filter 400

The EMC filter 400 may filter power and a control signal applied from the external power source (not shown) and controller (not shown), respectively. The EMC filter 400 may be configured such that an electrical signal in a preset or predetermined frequency range is only passed. To this end, the EMC filter 400 may include various electrical devices.

The power and the control signal filtered by the EMC filter 400 may be applied to the motor unit (not shown) through the inverter device (not shown).

During this filtering process, an electrical noise signal may be generated in the EMC filter 400. The electrical noise signal may be shielded by a shielding (or shield) plate 520 of the high-voltage connector assembly 500. Accordingly, the motor-operated compressor 10 may not be affected by the electrical noise signal.

The EMC filter 400 may be accommodated in the filter accommodating portion 340.

Figure 10:
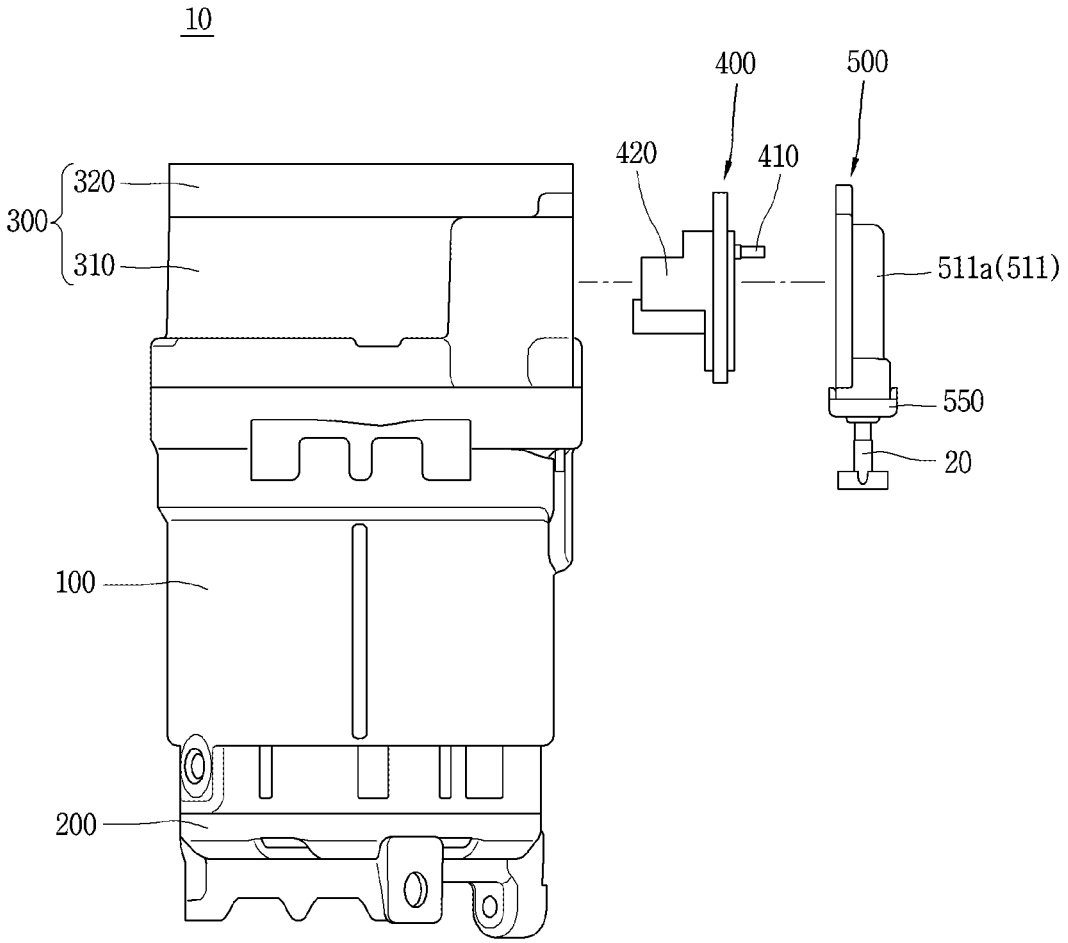
FIG. 10 is an exploded view illustrating a state in which a high-voltage connector assembly according to an embodiment of the present disclosure is coupled to a motor-operated compressor
Figure 11:
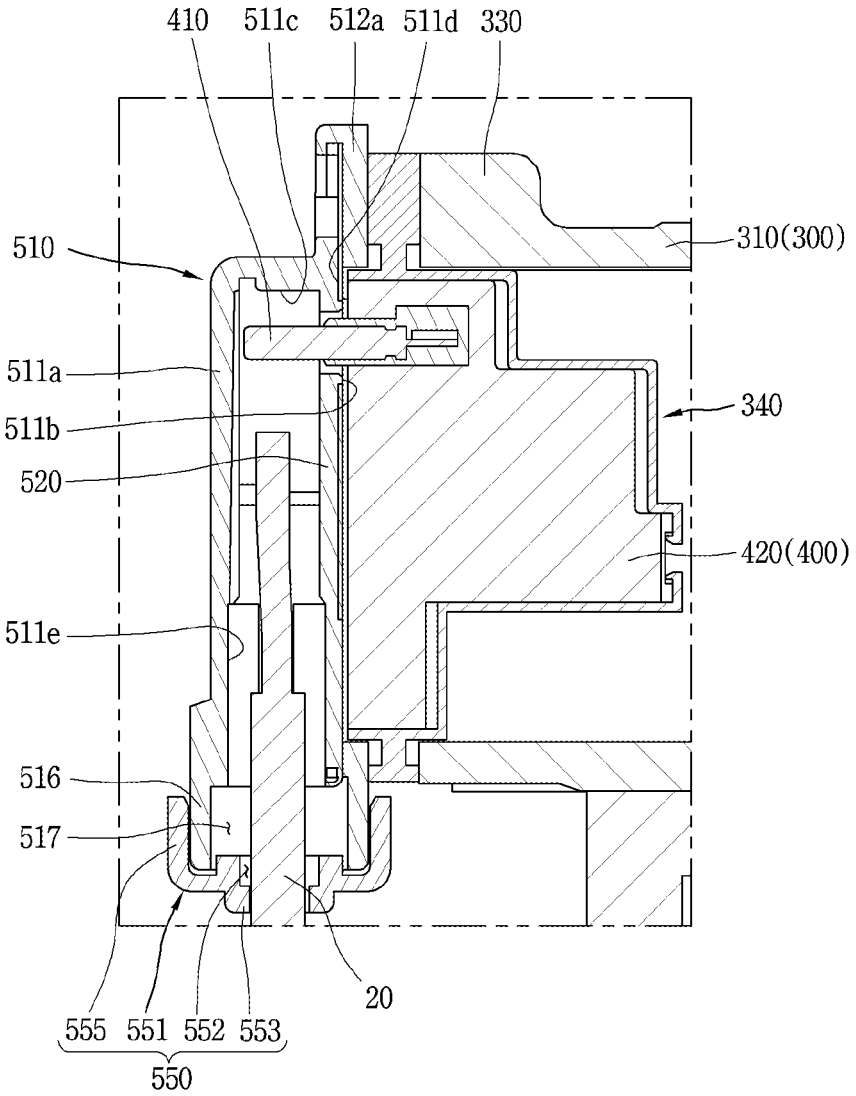
FIG. 11 is a cross-sectional view illustrating a state in which a high-voltage connector assembly according to an embodiment of the present disclosure is coupled to a motor-operated compressor.

Referring further to FIGS. 10 and 11, the EMC filter 400 may include an electric connection portion 410 and the filter body portion 420.

The inverter device (not shown) accommodated in the front housing 300 and the external power source (not shown) and controller (not shown) may be electrically connected by the electric connection portion 410. The electric connection portion 410 and the high-voltage cable 20 may be electrically connected to each other.

In detail, a terminal unit (not shown) made of a conductive material may be provided at one end of the high-voltage cable 20, which is electrically connected to the motor-operated compressor 10. The terminal unit (not shown) may be electrically connected to the electric connection portion 410, so that power and a control signal may be transmitted to the EMC filter 400.

The electric connection portion 410 may be electrically connected to the inverter device (not shown). One end of the electric connection portion 410 may be connected to the inverter device (not shown) by an electrically conductive member (not shown) such as a conducting wire.

In the illustrated embodiment, the electric connection portion 410 may be formed in a cylindrical shape extending in the lengthwise direction. In addition, the electric connection portion 410 may be coupled to the EMC filter 400 in a penetrating manner.

When the EMC filter 400 is inserted into the filter accommodating portion 340, one end of the electric connection portion 410 may protrude from an outer circumferential surface of the front housing 300. The high-voltage cable 20 may be electrically connected to the protruding end.

The filter body portion 420 may define the body of the EMC filter 400. The filter body portion 420 may be accommodated in the filter accommodating portion 340.

The filter body portion 420 may be made of an electrically conductive material. In the above embodiment, the filter body portion 420 and the inverter device (not shown) may be electrically connected to each other.

The electric connection portion 410 may be coupled to the filter body portion 420 in a penetrating manner. Power and a control signal transmitted through the electric connection portion 410 may be transferred to the inverter device (not shown) via the filter body portion 420.

After the filter body portion 420 is accommodated in the filter accommodating portion 340, the high-voltage connector assembly 500 may be coupled to the front housing 300 in a manner of covering the EMC filter 400. Accordingly, the EMC filter 400 may not be exposed to the outside.

Figure 4:
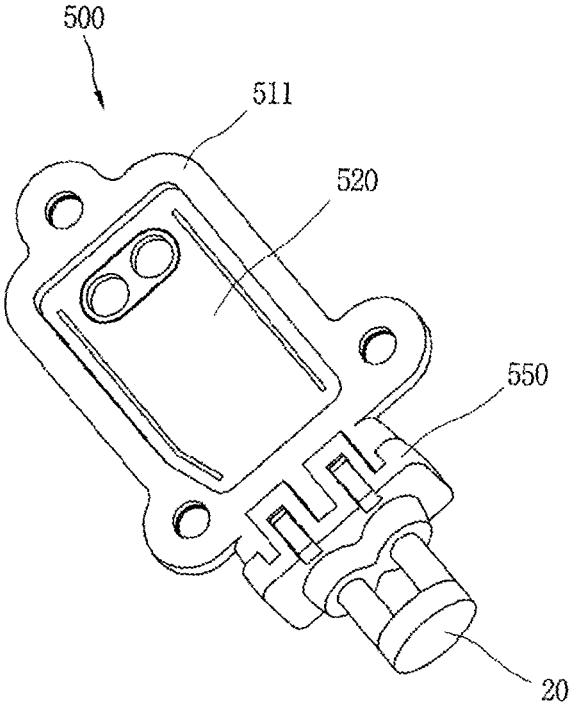
FIG. 4 is a perspective view of a high-voltage connector assembly applied to the motor-operated compressor of FIG. 3.
Figure 5:
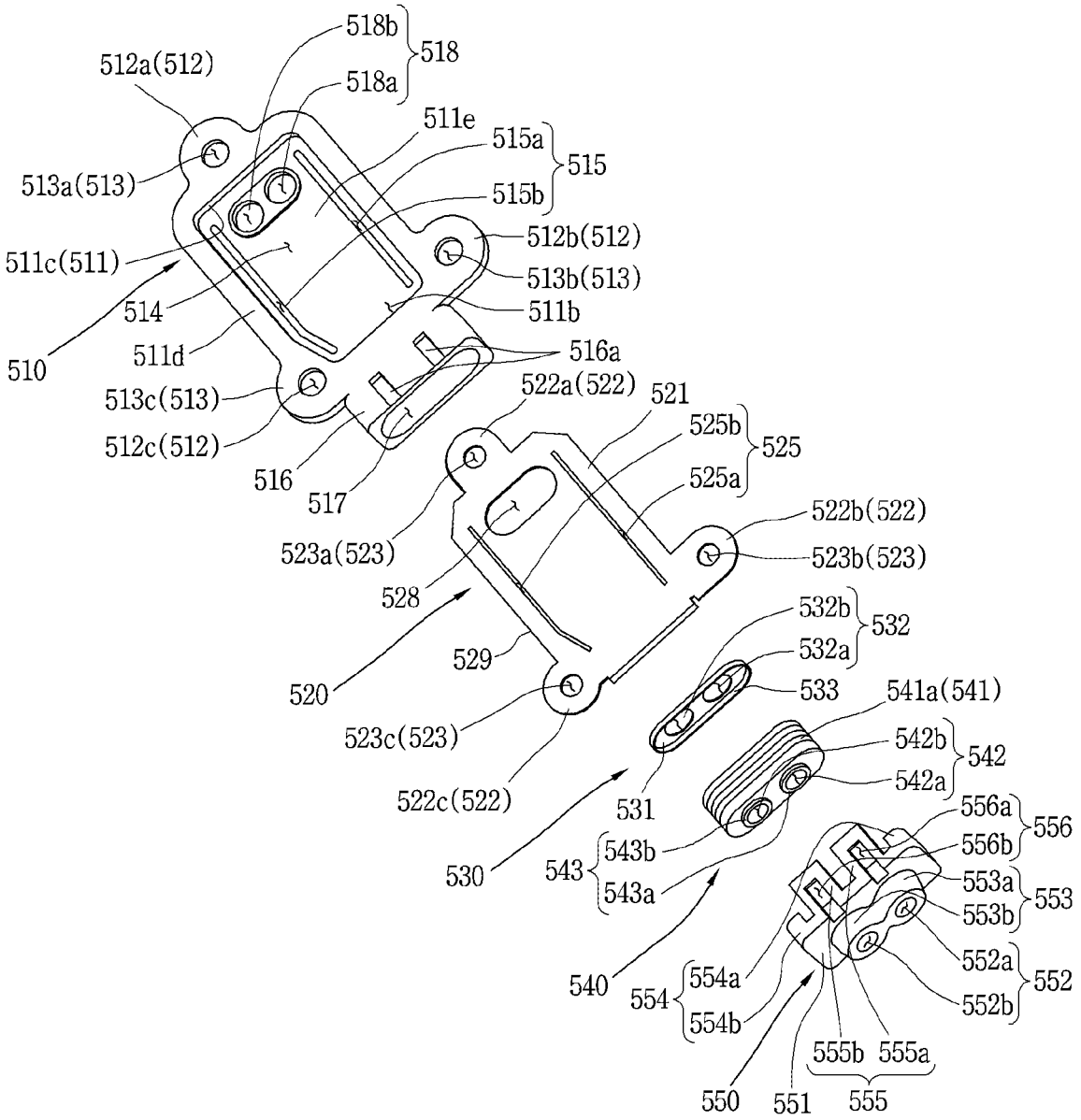
FIG. 5 is an exploded perspective view of the high-voltage connector assembly of FIG. 4.

3. Description of the High-Voltage Connector Assembly 500 According to Embodiment Referring to FIGS. 4 and 5, the motor-operated compressor 10 according an embodiment of the present disclosure may include the high-voltage connector assembly 500. The high-voltage cable 20 may be insertedly coupled to the high-voltage connector assembly 500. The high-voltage connector assembly 500 may support the high-voltage cable 20.

The high-voltage cable 20 may be inserted into the high-voltage connector assembly 500. One end of the inserted high-voltage cable 20 may be electrically connected to the electric connection portion 410 of the EMC filter 400.

The high-voltage connector assembly 500 may accommodate one end of the high-voltage cable 20. In addition, the high-voltage connector assembly 500 may accommodate one end of the electric connection portion 410. In an inner space of the high-voltage connector assembly 500, the high-voltage cable 20 and the electric connection portion 410 may be electrically connected to each other.

The high-voltage connector assembly 500 may be coupled to the connector coupling portion 330 provided at the front housing 300. In one embodiment, the high-voltage connector assembly 500 may be coupled to the connector coupling portion 330 by a screw.

The high-voltage connector assembly 500 may be configured to cover the EMC filter 400. Accordingly, the EMC filter 400 may not be exposed to the outside by the high-voltage connector assembly 500.

In addition, the high-voltage connector assembly 500 may shield an electrical noise signal generated in the EMC filter 400. Accordingly, the motor-operated compressor 10 may not be affected by the electrical noise signal.

Hereinafter, the high-voltage connector assembly 500 according to embodiments will be described in detail with reference to FIGS. 4 to 9.

As illustrated in the drawings, the high-voltage connector assembly 500 may include a cover 510, a shielding plate 520, a support plate 530, a sealing part (or unit) 540, and a holder 550.

In addition, the high-voltage connector assembly 500 may include a plate protrusion portion 560 and an uneven portion 570, so as to allow the cover 510 and the shielding plate 520 to be firmly or securely coupled to each other and prevent electric current leakage (see FIGS. 6 to 9).

(1) Description of the Cover 510

The cover 510 may define an outer appearance of the high-voltage connector assembly 500. A predetermined space may be provided inside the cover 510. The shielding plate 520 may be accommodated in the space.

As illustrated, the cover 510 may extend in a lengthwise direction, and protrude in a widthwise direction by a predetermined distance. A space may be formed in a portion of the cover 510 protruding in the widthwise direction. The high-voltage cable 20 and the electric connection portion 410 may be accommodated in the space.

The cover 510 may be made of an insulating material. In one embodiment, the cover 510 may be made of a synthetic resin.

The cover 510 may be integrally formed with the shielding plate 520. In one embodiment, the cover 510 and the shielding plate 520 may be made by double shot molding. In another embodiment, the cover 510 and the shielding plate 520 may be formed by insert injection molding.

This allows the cover 510 and the shielding plate 520 to be firmly coupled to each other. Detailed description thereof will be described hereinafter.

The cover 510 may include a cover body portion 511, a cover protruding portion 512, a cover coupling hole 513, a space portion 514, an alignment groove 515, a boss portion 516, a cable insertion portion 517, and an EMC accommodating portion 518.

The cover body portion 511 may define an outer appearance of the cover 510. The cover body portion 511 may have a rectangular parallelepiped shape with cut-off edges. One side of the cover body portion 511 may be provided with a raised portion 511*a* protruding by a predetermined distance (see FIG. 10).

In addition, the space portion 514 may be formed inside the raised portion 511*a*. The high-voltage cable 20 and the electric connection portion 410 may be accommodated in the space portion 514.

An outer circumference of the cover body portion 511 may be provided with the cover protruding portion 512 protruding therefrom. In addition, the boss portion 516 may be provided at one side of the cover body portion 511 facing the holder 550 in a protruding manner.

The cover body portion 511 may include the raised portion 511*a*, an opening portion 511*b*, and an inner circumferential portion 511*c*.

The raised portion 511*a* may protrude from one surface of the cover body portion 511. The space portion 514 may be provided in the raised portion 511*a*. The space portion 514 may accommodate one end of the high-voltage cable 20 and the electric connection portion 410 therein.

The opening portion 511*b* may be provided at one side of the cover body portion 511, which is opposite to the raised portion 511*a*.

The opening portion 511*b* may be formed through the one side of the cover body portion 511. The opening portion 511*b* may provide communication between an outside of the cover body portion 511 and the space portion 514.

The opening portion 511*b* may be covered by the shielding plate 520. That is, the shielding plate 520 may be exposed to an outside of the cover 510 by the opening portion 511*b*.

The inner circumferential portion 511*c* may form a boundary inside the cover body portion 511. The shielding plate 520 may be in contact with the inner circumferential portion 511*c*. In detail, a plate outer circumferential portion 529 of the shielding plate 520 may come in contact with the inner circumferential portion 511*c*.

The inner circumferential portion 511*c* may be located inside of one surface of the cover body portion 511 at which the opening portion 511*b* is formed. The inner circumferential portion 511*c* may be located outward than an inner circumference of a first surface 511*d* of the cover body portion 511 that surrounds the opening portion 511*b*.

Accordingly, when the cover 510 and the shielding plate 520 are coupled to each other, a part or portion of the shielding plate 520, namely, a portion that corresponds to an area of the opening portion 511*b* may only be exposed to the outside.

The cover protruding portion 512 is a portion of the high-voltage connector assembly 500 which is to be coupled to the front housing 300. The cover protruding portion 512 may protrude from an outer circumference of the cover body portion 511 by a predetermined distance.

In the illustrated embodiment, a first cover protruding portion 512*a*, a second cover protruding portion 512*b*, and a third cover protruding portion 512*c* protruding from one edge of the cover body portion 511 in the lengthwise direction and both corners of the cover body portion 511 in the widthwise direction, respectively. The number of cover protruding portions 512 may be changed.

In the illustrated embodiment, the cover protruding portion 512 has a semi-circular shape with a rounded outer end. The number of cover protruding portions 512 may vary.

The cover coupling hole 513 may be formed inside the cover protruding portion 512 in a penetrating manner.

A coupling member (not shown) may be coupled to the cover coupling hole 513 in a penetrating manner. One end of the coupling member (not shown) coupled through the cover coupling hole 513 may be coupled to the front housing 300, which allows the high-voltage connector assembly 500 and the front housing 300 to be coupled to each other.

The cover coupling hole 513 may be provided in plurality. In the illustrated embodiment, first to third cover coupling holes 513*a*, 513*b*, and 513*c* are formed through the first to third cover protruding portions 512*a*, 512*b*, and 512*c*, respectively.

Each of the cover coupling holes 513*a*, 513*b*, and 513*c* may be aligned with shielding plate coupling holes 523*a*, 523*b*, 523*c* of the shielding plate 520, respectively. A coupling member (not shown) may be coupled to each of the cover coupling holes 513*a*, 513*b*, and 513*c* and each of the shielding plate coupling holes 523*a*, 523*b*, and 523*c* in a penetrating manner.

The space portion 514 may be defined as a space formed inside the cover body portion 511. The high-voltage cable 20 and the electric connection portion 410 may be accommodated in the space portion 514. In the space portion 514, the high-voltage cable 20 and the electric connection portion 410 may be electrically connected to each other.

The space portion 514 may be surrounded by the cover body portion 511 and the shielding plate 520.

That is, when the shielding plate 520 and the cover 510 are coupled to each other, the space portion 514 and the opening portion 511*b* may be physically separated from each other by the shielding plate 520. Accordingly, one side of the space portion 514 may be surrounded by the shielding plate 520.

In addition, one side of the space portion 514 opposite to the shielding plate 520 may be surrounded by an inner surface of the raised portion 511*a*.

The alignment groove 515 may guide the shielding plate 520, such that the shielding plate 520 is coupled to a predetermined position inside the cover 510.

The alignment groove 515 may be recessed from the inner surface of the raised portion 511*a* by a predetermined distance. An alignment recess 525 of the shielding plate 520 may be inserted into the alignment groove 515.

In the illustrated embodiment, the alignment groove 515 may include a first alignment groove 515*a* having a bent portion at a lower side thereof, and a second alignment groove 515*b* having a linear shape. The first alignment groove 515*a* and the second alignment groove 515*b* may be spaced apart from each other by a predetermined distance.

A position, shape, and number of the alignment groove 515 may differ according to a position, shape, and number of the alignment recess 525.

The boss portion 516 is a portion to which the holder 550 is coupled. In addition, a hollow portion may be formed in the boss portion 516, so that the high-voltage cable 20, the support plate 530, and the sealing part 540 are inserted.

The boss portion 516 may protrude from the cover body portion 511 by a predetermined distance. In the illustrated embodiment, the boss portion 516 is located at one side of the cover body portion 511 opposite to the first cover protruding portion 512*a*.

A holder coupling protrusion 516*a* may protrude from both surfaces of the boss portion 516, namely, both surfaces facing the raised portion 511*a* and the opening 511*b*. The holder coupling protrusion 516*a* may be insertedly coupled to a cover insertion hole 556 of the holder 550. In one embodiment, the holder coupling protrusion 516*a* may be snap-fitted to the cover insertion hole 556.

In the illustrated embodiment, each of the surfaces may be provided with two holder coupling protrusions 516*a*, respectively. The holder coupling protrusions 516*a* may be disposed to be spaced apart from each other by a predetermined distance. A position and number of the holder coupling protrusion 516*a* may differ according to a position and number of the cover insertion hole 556.

The boss portion 516 may be provided therein with the cable insertion portion 517.

The cable insertion portion 517 is a passage through which the high-voltage cable 20 is inserted into the space portion 514. The cable insertion portion 517 may be formed in a penetrating manner, so that the space portion 514 and the outside of the cover body portion 511 communicate with each other.

The cable insertion portion 517 may accommodate the support plate 530 and the sealing part 540 therein. In one embodiment, the support plate 530 and the sealing part 540 are inserted sequentially, so that one side of the support plate 530 facing the cover 510 is brought into contact with the shielding plate 520 to be supported.

A shape and size (or dimensions) of the cable insertion portion 517 may, preferably, be determined according to a shape and size of the support plate 530 and the sealing part 540.

The cable insertion portion 517 may be covered by the holder 550. That is, the cable insertion portion 517 may be hermetically sealed by the support plate 530, the sealing part 540, and the holder 550.

The EMC accommodating portion 518 may accommodate one end of the electric connection portion 410. As described above, the electric connection portion 410 may extend in the lengthwise direction. Once the EMC filter 400 is coupled to the front housing 300, the electric connection portion 410 may protrude outside of the front housing 300.

The EMC accommodating portion 518 is a space through which one end of the electric connection portion 410 protruding outward passes. To this end, the EMC accommodating portion 518 may be recessed from the inner surface of the raised portion 511*a* by a predetermined distance.

In the illustrated embodiment, the EMC accommodating portion 518 may be configured as a first EMC accommodating portion 518*a* and a second EMC accommodating portion 518*b*. A position and number of the EMC accommodating portion 518 may differ according to a position and number of the electric connection portion 410.

The EMC accommodating portion 518 may be aligned with an EMC penetrating portion 528 of the shielding plate 520. One end of the electric connection portion 410 may be formed through the EMC penetrating portion 528, so as to be accommodated in the EMC accommodating portion 518.

(2) Description of the Shielding Plate 520

The shielding plate 520 may be configured to shield an electrical noise signal generated when the EMC filter 400 is in operation. The motor-operated compressor 10 or any electronic device (not shown) around the motor-operated compressor 10 may not be affected by the electrical noise signal due to the shielding plate 520.

The shielding plate 520 may be provided in the form of absorbing an electrical signal. In addition, the shielding plate 520 may be made of a conductive material. In one embodiment, the shielding plate 520 may be made of a brass material.

The shielding plate 520 may be coupled to the cover 510. The shielding plate 520 may be accommodated in the space portion 514 of the cover 510. The shielding plate 520 may be disposed to cover the opening portion 511*b*. The plate outer circumferential portion 529 of the shielding plate 520 may be in contact with the inner circumferential portion 511*c*.

The shielding plate 520 may be integrally formed with the cover 510. In one embodiment, the shielding plate 520 and the cover 510 may be formed by double shot molding. In another embodiment, the shielding plate 520 and the cover 510 may be made by insert injection molding.

Accordingly, manufacturing costs and time, etc. may be reduced as compared when the shielding plate 520 and the cover 510 are manufactured separately to be coupled. In addition, this may allow the shielding plate 520 and the cover 510 to be stably coupled to each other.

The shielding plate 520 may include a shielding plate body portion 521, a shielding plate protruding portion 522, a shielding plate coupling hole 523, the alignment recess 525, the EMC penetrating portion 528, and the plate outer circumferential portion 529.

The shielding plate body portion 521 may define the body of the shielding plate 520. The shielding plate body portion 521 may be formed in a rectangular plate shape.

A bent portion may be formed at one end of the shielding plate body portion 521 facing the holder 550. The bent portion may come in contact with the support plate 530 inserted into the cable insertion portion 517. Accordingly, an (allowable) insertion distance of the support plate 530 and the sealing part 540 may be restricted.

The shielding plate protruding portion 522 may protrude from an edge of the shielding plate body portion 521. The shielding plate protruding portion 522 may be aligned with the cover protruding portion 512. In detail, one surface of the cover protruding portion 512 facing the raised portion 511*a* and another surface at an opposite side are spaced apart from each other by a predetermined distance, thereby forming a space. The shielding plate protruding portion 522 may be inserted into the space.

In the illustrated embodiment, three shielding plate protruding portions 522 including a first shielding plate protruding portion 522*a*, a second shielding plate protruding portion 522*b*, and a third shielding plate protruding portion 522*c* are provided.

The shielding plate 520, which is opposite to the holder 550, may be provided with the first shielding plate protruding portion 522*a* protruding from its one end portion in the lengthwise direction. The second shielding plate protruding portion 522*b* and the third shielding plate protruding portion 522*c* may protrude from both corners of the shielding plate 520 in the widthwise direction, respectively. The shielding plate protruding portion 522 may have a semi-circular shape with a rounded end.

A position, shape, and number of the shielding plate protruding portion 522 may differ according to a position, shape, and number of the cover protruding portion 512.

The shielding plate protruding portion 522 may be provided with the shielding plate coupling hole 523. A coupling member (not shown) may be coupled to the shielding plate coupling hole 523 in a penetrating manner. The shielding plate coupling hole 523 may be formed through the shielding plate protruding portion 522.

The shielding plate coupling hole 523 may be aligned with the cover coupling hole 513. In one embodiment, the shielding plate coupling hole 523 and the cover coupling hole 513 may be disposed to have a same central axis.

In the illustrated embodiment, the shielding plate coupling hole 523 may include a first shielding plate coupling hole 523*a*, a second shielding plate coupling hole 523*b*, and a third shielding plate coupling hole 523*c*. Each of the shielding plate coupling holes 523*a*, 523*b*, 523*c* may be provided at the shielding plate protruding portions 522*a*, 522*b*, 522*c*, respectively.

Each of the shielding plate coupling holes 523*a*, 523*b*, and 523*c* may be aligned with the cover coupling holes 513*a*, 513*b*, and 513*c*, respectively.

The alignment recess 525 may guide the shielding plate 520, so that the shielding plate 520 and the cover 510 are coupled to each other at a predetermined position.

The alignment recess 525 may be recessed from one surface of the shielding plate 520 by a predetermined distance. A protruding portion may protrude from another surface of the shielding plate 520, opposite to the one surface, by a recessed distance of the alignment recess 525. In one embodiment, the recessed distance may be a protruding distance of the raised portion 511*a*.

The alignment recess 525 may be inserted into the alignment groove 515. In detail, as the alignment recess 525 is formed in a recessed manner, the protruding portion protruding from the another surface of the shielding plate 520 may be inserted into the alignment groove 515.

In the illustrated embodiment, the alignment recess 525 may include a first alignment recess 525*a* having a bent portion at a lower side thereof and a second alignment recess 525*b* having a linear shape. The first alignment recess 525*a* and the second alignment recess 525*b* may be spaced apart from each other by a predetermined distance.

A position, shape, and number of the alignment recess 525 may differ according to a position, shape, and number of the alignment recess 515.

The EMC penetrating portion 528 is a space through which the electric connection portion 410 of the EMC filter 400 passes. One end of the electric connection portion 410 that has passed through the EMC penetrating portion 528 may be accommodated in the EMC accommodating portion 518.

The EMC penetrating portion 528 may be formed through one side of the shielding plate body portion 521. In detail, the EMC penetrating portion 528 may be formed in a direction toward the first shielding plate protruding portion 522*a*.

The EMC penetrating portion 528 may be aligned with the EMC accommodating portion 518. In the illustrated embodiment, the EMC accommodating portion 518 may be formed as two recessed portions. The EMC penetrating portion 528 may be configured such that the first EMC accommodating portion 518*a* and the second EMC accommodating portion 518*b* are exposed to the outside through the EMC penetrating portion 528.

One end of the electric connection portion 410 may pass through the EMC penetrating portion 528 to be accommodated in the EMC accommodating portion 518.

The plate outer circumferential portion 529 may define an outer circumference of the shielding plate body portion 521 and the shielding plate protruding portion 522. In other words, the plate outer circumferential portion 529 is the outer circumference of the shielding plate 520.

When the shielding plate 520 and the cover 510 are coupled to each other, the plate outer circumferential portion 529 may be brought into contact with the inner circumferential portion 511*c*.

In one embodiment, the plate outer circumferential portion 529 may be provided with the plate protrusion portion 560 or the uneven portion 570 to be described hereinafter. In the above embodiment, a frictional force between the plate outer circumferential portion 529 and the inner circumferential portion 511*c* may be increased. As a result, a coupling force between the shielding plate 520 and the cover 510 may be increased.

In addition, in the above embodiment, a contact area between the plate outer circumferential portion 529 and the inner circumferential portion 511*c* may be increased. Accordingly, even when the cover 510 and the shielding plate 520 are thermally expanded to different degrees, shape deformation may be minimized. Detailed description thereof will be described hereinafter.

In one embodiment, the plate outer circumferential portion 529 may have higher roughness than the inner circumferential portion 511*c*.

This configuration may allow a frictional force between the plate outer circumferential portion 529 and the inner circumferential portion 511*c* to be increased. Accordingly, a coupling force between the shielding plate 520 and the cover 510 may be increased.

In order to increase roughness of the plate outer circumferential portion 529, a plurality of minute-sized grooves may be punched into the plate outer circumferential portion 529. Alternatively, a plurality of patterns of the teeth of a comb may be formed on the plate outer circumferential portion 529, thereby increasing the roughness.

In addition to the methods described above, other processing or fabrication methods may also be applied to the plate outer circumferential portion 529 to increase the roughness of the plate outer circumferential portion 529.

(3) Description of the Support Plate 530

The support plate 530 may support the high-voltage cable 20 inserted into the cover 510. The support plate 530 may prevent the high-voltage cable 20 from being separated or detached from the high-voltage connector assembly 500. In addition, the support plate 530 may prevent a position of the high-voltage cable 20 inserted into the cover 510 from being changed arbitrarily.

In addition, an electrical noise signal transmitted to the shielding plate 520 may be grounded by the support plate 530.

In other words, the shielding plate 520 may prevent an electrical noise signal generated in the EMC filter 400 from being leaked to the outside. At this time, since the electrical noise signal does not disappear (or dissipate), the electrical noise signal is transmitted to the shielding plate 520.

The support plate 530 may be in electrical contact with the shielding plate 520, which allows the shielding plate 520 to be grounded. That is, the electrical noise signal transmitted to the shielding plate 520 may be discharged to the outside of the motor-operated compressor 10 through the support plate 530.

The support plate 530 may be insertedly coupled to the cable insertion portion 517 provided at the boss portion 516. A shape and size of the support plate 530 may, preferably, be determined according to a shape and size of the cable insertion portion 517.

The support plate 530 may include a support plate body portion 531, a cable through hole 532, and a guide portion 533.

The support plate body portion 531 may define the body of the support plate 530. In the illustrated embodiment, the support plate body portion 531 may extend in the widthwise direction, and both edges of the lengthwise direction are rounded.

The support plate body portion 531 may have a shape that may be inserted into the cable insertion portion 517 so as to be in electrical contact with the shielding plate 520.

The cable through hole 532 may be formed through the support plate body portion 531. The high-voltage cable 20 may be coupled to the cable through hole 532 in a penetrating manner. A size and shape of the cable through hole 532 may be determined according to a size and shape of a cross section of the high-voltage cable 20.

In the illustrated embodiment, the cable through hole 532 includes a first cable through hole 532*a* and a second cable through hole 532*b*. The first cable through hole 532*a* and the second cable through hole 532*b* may be disposed to be spaced apart from each other by a predetermined distance.

The predetermined distance between the first cable through hole 532*a* and the second cable through hole 532*b* may, preferably, be determined according to a distance between the first EMC accommodating portion 518*a* and the second EMC accommodating portion 518*b*. In addition, the predetermined distance may, preferably, be determined according to a distance between a first cable insertion hole 542*a* and a second cable insertion hole 542*b* of the sealing part 540.

Preferably, each of the distances between the EMC accommodating portions 518*a* and 518*b*, between the cable through holes 532*a* and 532*b*, and between the cable insertion holes 542*a* and 542*b* may be equal.

In this embodiment, the two-strand (or line) high-voltage cable 20 may go straight without being bent to be electrically connected to an end of the electric connection portion 410.

The guide portion 533 may divide (or arrange) a space for the sealing part 540 and the support plate 530 to be coupled to each other.

The guide portion 533 may protrude from an outer circumference of the support plate body portion 531 in a direction toward the sealing part 540 by a predetermined distance. The sealing part 540 may be insertedly coupled to a space inside the support plate body portion 531 divided by the guide portion 533.

(4) Description of the Sealing Part 540

The sealing part 540 may block communication between the space portion 514 of the cover 510 and the outside. That is, the sealing part 540 may seal an inner space of the cover 510, so as to physically separate an inside of the cover 510 from the outside.

Accordingly, any foreign matter, except the high-voltage cable 20 or the electric connection portion 410, may not be introduced into the space portion 514 of the cover 510. To this end, the sealing part 540 may be configured to surround the high-voltage cable 20 inserted into the cable insertion portion 517.

The sealing part 540 may be partially inserted into the support plate 530. In detail, the sealing part 540 may be seated in an inner space of the support plate 530 divided by the guide portion 533.

The sealing part 540 may be made of a material that allows deformation of a shape to an extent. In one embodiment, the sealing part 540 may be made of a rubber material.

A shape and size of the sealing part 540 may be determined according to a shape and size of the cable insertion portion 517. In one embodiment, the sealing part 540 may be larger than the cable insertion portion 517.

In the above embodiment, the sealing part 540 may be inserted into the cable insertion portion 517 in a deformed state with a restoring force. In this case, the sealing part 540 may be securely inserted into the cable insertion portion 517.

The sealing part 540 may include a sealing body portion 541, a cable insertion hole 542 and an insertion hole outer circumferential portion 543.

The sealing body portion 541 may define the body of the sealing part 540. The sealing body portion 541 may extend in the widthwise direction, and each of corners is cut-off. A shape of the sealing body portion 541 may be a shape that allows the sealing body portion 541 to be coupled to the support plate 530 and to be inserted into the cable insertion portion 517.

The sealing body portion 541 may include a plurality of plate members 541*a*. The plurality of plate members 541*a* may be spaced apart from each other by a predetermined distance to be stacked, thereby defining the sealing body portion 541. The plurality of plate members 541*a* may maintain a stacked state by a connecting member (not shown).

As the sealing body portion 541 is formed by the plurality of plate members 541*a*, a sealing effect of the space portion 514 may be enhanced.

The high-voltage cable 20 may be inserted into the cable insertion hole 542 in a penetrating manner. The cable insertion hole 542 may penetrate in the lengthwise direction.

In the illustrated embodiment, the cable insertion hole 542 may include the first cable insertion hole 542*a* and the second cable insertion hole 542*b* spaced apart from each other by a predetermined distance.

The predetermined distance may, preferably, be equal to the distance between the EMC accommodating portions 518*a* and 518*b*, and the distance between the cable through holes 532*a* and 532*b*, as described above.

In addition, the predetermined distance between the cable insertion holes 542*a* and 542*b* may, preferably, be equal to a distance between holder through holes 552*a* and 552*b*.

The insertion hole outer circumferential portion 543 may be configured to surround and support the high-voltage cable 20 inserted into the cable insertion hole 542. The insertion hole outer circumferential portion 543 may be formed along an outer circumference of the cable insertion hole 542. In addition, the insertion hole outer circumferential portion 543 may protrude toward the holder 550 by a predetermined distance from one surface of the plate member 541*a* facing the holder 550.

The insertion hole outer circumferential portion 543 may include a first insertion hole outer circumferential portion 543*a* and a second insertion hole outer circumferential portion 543*b*. The first insertion hole outer circumferential portion 543*a* may be formed at the first cable insertion hole 542*a*. Similarly, the second insertion hole outer circumferential portion 543*b* may be formed at the second cable insertion hole 542*b*.

Accordingly, when the high-voltage cable 20 is inserted into the respective cable insertion holes 542*a* and 542*b*, the high-voltage cable 20 may be covered to be sealed by the respective insertion hole outer circumferential portions 543*a* and 543*b*. Thus, communication between the space portion 514 inside the cover 510 and the outside may be blocked.

The insertion hole outer circumferential portion 543 may be insertedly coupled to the holder through holes 552*a* and 552*b*, respectively.

(5) Description of the Holder 550

The holder 550 and the cover 510 may be coupled to each other in a detachable manner. In detail, the holder 550 may be coupled to the boss portion 516 of the cover 510. This configuration may allow the support plate 530 inserted into the cable insertion portion 517 and the sealing part 540 to be securely coupled to the cover 510.

In addition, the holder 550 may be configured to cover the cable insertion portion 517. The cable insertion portion 517 may be hermetically sealed by the sealing part 540 and the holder 550. That is, the holder 550 may be configured to seal the inside of the cover 510.

The holder 550 may be made of an insulating material. In one embodiment, the holder 550 may be made of a synthetic resin or the like.

The holder 550 may be made of a material that may allow deformation of a shape to an extent. This allows the holder 550 and the cover 510 to be snap-fitted to each other.

In the illustrated embodiment, the holder 550 may extend in the widthwise direction. A shape of the holder 550 may differ according to a shape of the boss portion 516.

The holder 550 may include a holder body portion 551, a holder through hole 552, a cable support portion 553, a cover connecting portion 554, a cover coupling portion 555, and the cover insertion hole 556.

The holder body portion 551 may define the body of the holder 550. In the illustrated embodiment, the holder body portion 551 may extend in the widthwise direction, and have a rectangular parallelepiped plate shape with cut-off corners. A shape of the holder body portion 551 may be a shape suitable for shielding the cable insertion portion 517.

A size of the holder body portion 551 may, preferably, be larger than a size of the cable insertion portion 517. In one embodiment, the size of the holder body portion 551 may be equal to a cross section of the boss portion 516.

The holder body portion 551 may be provided with the cover connecting portion 554 protruding from its both ends in the widthwise direction toward the cover 510 in the lengthwise direction by a predetermined distance. In addition, the cover coupling portion 555 may protrude toward the cover 510 from another both ends, not the both ends, of the holder body portion 551.

The holder through hole 552 may be formed through the holder body 551. The high-voltage cable 20 may be inserted into the holder through hole 552 in a penetrating manner.

In the illustrated embodiment, the holder through hole 552 may include a first holder through hole 552*a* and a second holder through hole 552*b*. The first holder through hole 552*a* and the second holder through hole 552*b* may be spaced apart from each other by a predetermined distance.

Each of the holder through holes 552*a* and 552*b*, each of the cable insertion holes 542*a* and 542*b*, and each of the cable through holes 532*a* and 532*b* may be disposed to have a same central axis. In addition, each of the holder through holes 552*a* and 552*b*, each of the cable insertion holes 542*a* and 542*b*, and each of the cable through holes 532*a* and 532*b* may be disposed to have a same central axis to each of the EMC accommodating portions 518*a* and 518*b*.

This configuration may allow the high-voltage cable 20 to be in electrical contact with the electric connection portion 410 in a straight manner without being curved or bent.

The cable support portion 553 may be configured to support the high-voltage cable 20 inserted into the cable insertion hole 542. The cable support portion 553 may surround the outer circumference of the cable insertion hole 542.

The cable support portion 553 may protrude from one surface of the holder body portion 551, which is opposite to the cover 510, by a predetermined distance. This configuration may allow the high-voltage cable 20 inserted into the cable insertion hole 542 to be stably supported.

In the illustrated embodiment, the cable support portion 553 may include a first cable support portion 553*a* and a second cable support portion 553*b*. The first cable support portion 553*a* and the second cable support portion 553*b* may be spaced apart from each other by a predetermined distance.

As described above, each of the cable support portions 553*a* and 553*b* may be disposed to have the same central axis as each of the holder through holes 552*a* and 552*b*, each of the cable insertion holes 542*a* and 542*b*, and each of the cable through holes 532*a* and 532*b*.

The cover connecting portion 554 is a portion to which the holder 550 and the boss portion 516 are coupled. The cover connecting portion 554 may be configured to surround both ends of the boss portion 516 in the widthwise direction.

The cover connecting portion 554 may be located at both ends of the holder 550 in the widthwise direction. The cover connecting portion 554 may protrude in a direction toward the cover 510 by a predetermined distance.

In the illustrated embodiment, the cover connecting portion 554 may include a first cover connecting portion 554*a* and a second cover connecting portion 554*b*. This is because the cover coupling portion 555 is provided at an edge of the holder 550 where the cover connecting portion 554 is not formed.

The cover coupling portion 555 is a portion to which the holder 550 and the cover 510 are coupled. The cover insertion hole 556 may be formed through the cover coupling portion 555, so that the holder coupling protrusion 516*a* of the boss portion 516 is insertedly coupled to the cover coupling portion 555.

The cover coupling portion 555 may protrude toward the cover 510 by a predetermined distance from both edges of the holder body portion 551 where the cover connecting portion 554 is not formed.

In the illustrated embodiment, the cover coupling portion 555 may include a first cover coupling portion 555*a* and a second cover coupling portion 555*b*. The first cover coupling portion 555*a* and the second cover coupling portion 555*b* may be spaced apart from each other by a predetermined distance.

The predetermined distance should be determined according to the distance between the plurality of holder coupling protrusions 516*a*.

The cover insertion hole 556 may be formed through the cover coupling portion 555.

The cover insertion hole 556 is a portion in which the holder coupling protrusion 516*a* is inserted. In one embodiment, the holder coupling protrusion 516*a* may be snap-fitted to the cover insertion hole 556. Accordingly, when the cover 510 and the holder 550 are coupled to each other, they are not arbitrarily separated unless an external force is applied.

In addition, a separate (or additional) coupling member such as a screw member is not required to couple the cover 510 and the holder 550 to each other. This may allow the cover 510 and the holder 550 to be coupled to each other in an easier manner, thereby simplifying a structure.

The cover insertion hole 556 may be formed through the cover coupling portion 555 at a predetermined angle with a lengthwise direction of the cover coupling portion 555. In one embodiment, the cover insertion hole 556 may be formed through the cover coupling portion 555 perpendicular to the lengthwise direction of the cover coupling portion 555.

A position, shape, and size of the cover insertion hole 556 may be determined according to a position, shape, and size of the holder coupling protrusion 516*a*.

In the illustrated embodiment, the cover insertion hole 556 may include a first cover insertion hole 556*a* and a second cover insertion hole 556*b*. The first cover insertion hole 556*a* may be formed through the first cover coupling portion 555*a*. Likewise, the second cover insertion hole 556*b* may be formed through the second cover coupling portion 555*b*.

The holder coupling protrusion 516*a* may be insertedly coupled to the cover insertion holes 556*a* and 556*b*, respectively. As described above, the holder coupling protrusion 516*a* may be coupled to the cover insertion holes 556*a* and 556*b*, respectively, in a snap-fit manner.

(6) Description of the Plate Protrusion Portion 560

Figure 6A:
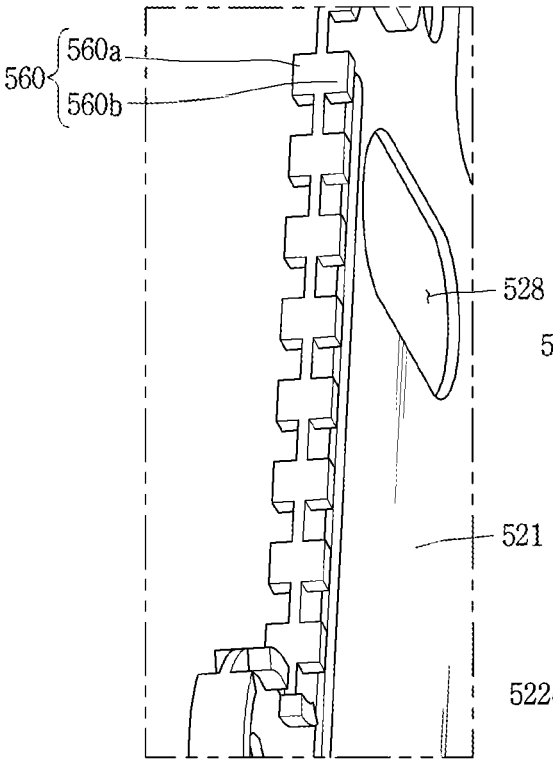
FIGS. 6A and 6B are a perspective view and a planar views, respectively, illustrating a high-voltage connector assembly according to another embodiment of the present disclosure.
Figure 6B:
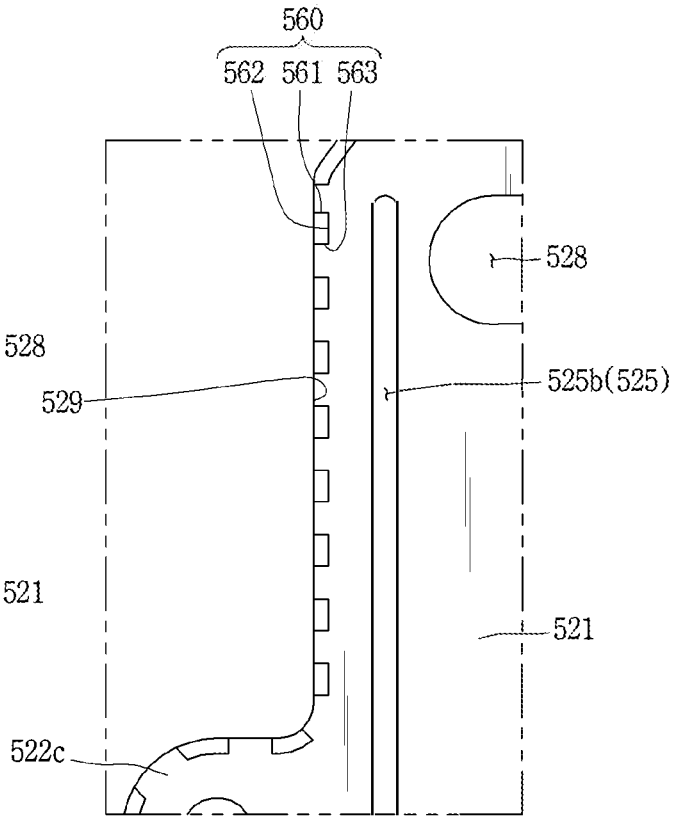
Figure 7:
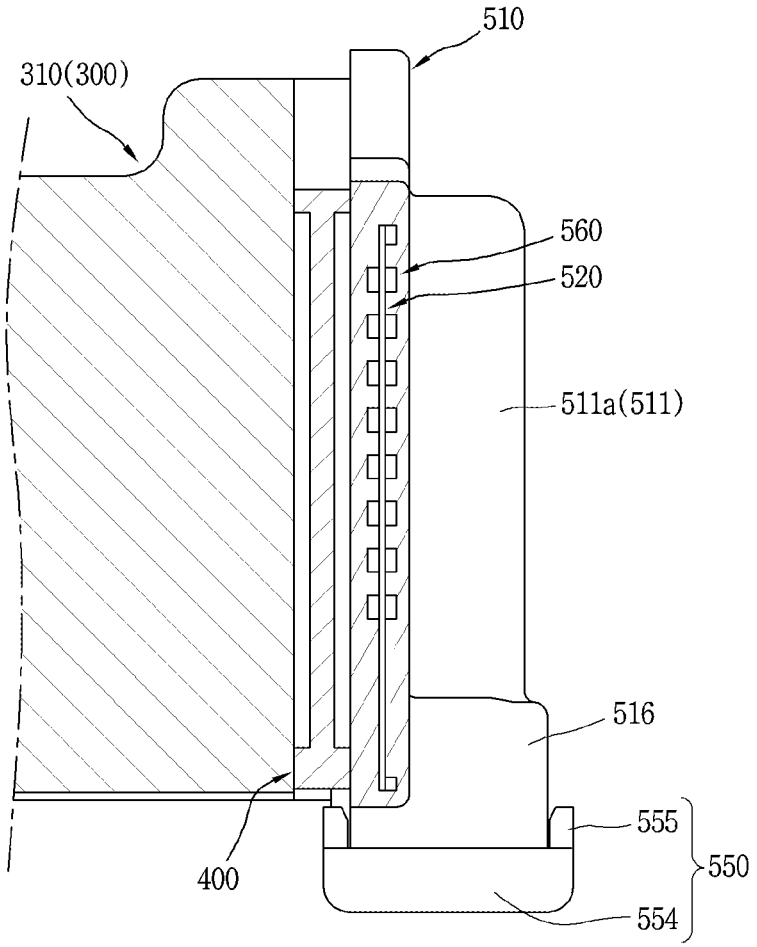
FIG. 7 is a cross-sectional view illustrating a state in which the high-voltage connector assembly of FIG. 6 is coupled to the motor-operated compressor.

Referring to FIGS. 6 and 7, the high-voltage connector assembly 500 according to embodiments may include the plate protrusion portion (or plate protrusion) 560.

The plate protrusion portion 560 may be configured to increase a surface area of the plate outer circumferential portion 529. Accordingly, a clearance generated by a difference in the coefficient of thermal expansion between the cover 510 and the shielding plate 520 may be minimized. Further, a coupling force between the cover 510 and the shielding plate 520 may be enhanced.

In addition, the plate protrusion portion 560 may be configured to form a surface of the plate outer circumferential portion 529 in a more complicated manner. Accordingly, the coupling force between the cover 510 and the shielding plate 520 may be improved as compared when the surface of the plate outer circumferential portion 529 is formed on a single smooth surface.

The plate protrusion portion 560 may allow the shielding plate 520 to stably maintain a shielded state of the opening portion 511*b* of the cover 510.

As a result, water or dust at the outside may not be introduced into the space portion 514 of the cover 510, so that the high-voltage cable 20 and the electric connection portion 410 are electrically connected in a more stable manner.

The plate protrusion portion 560 may be provided in plurality. The plurality of plate protrusion portions 560 may be sequentially disposed to be spaced apart from one another by a predetermined distance along the plate outer circumferential portion 529.

A space formed between the plurality of plate protrusion portions 560 may compensate for an increase in volume caused by thermal expansivity of the cover 510 or the shielding plate 520.

In the illustrated embodiment, the plate protrusion portion 560 may include a first plate protrusion portion 560*a* and a second plate protrusion portion 560*b*.

The first plate protrusion portion 560*a* may protrude from one surface of the shielding plate body portion 521 by a predetermined distance. The second plate protrusion portion 560*b* may protrude from another surface of the shielding plate body portion 521, opposite to the one surface, by a predetermined distance.

The protruding distances of the first plate protrusion portion 560*a* and the second plate protrusion portion 560*b* may be changed according to a shape of the cover 510.

In detail, the cover 510 may include the first surface 511*d* on which the opening portion 511*b* is formed, and the second surface 511*e* opposite to the first surface 511*d* and spaced apart from the first surface 511*d* by a predetermined distance, so as to surround the space portion 514.

The plate outer circumferential portion 529 may be inserted into a space formed between the first surface 511*d* and the second surface 511*e* to be in contact with the inner circumferential portion 511*c*.

Here, the first plate protrusion portion 560*a* and the second plate protrusion portion 560*b* may be formed such that the sum of the protruding distances is equal to the predetermined distance between the first surface 511*d* and the second surface 511*e*.

In one embodiment, the first plate protrusion portion 560*a* and the second plate protrusion portion 560*b* may protrude by the same distance. In the embodiment, since the center of gravity of the shielding plate 520 is located at a central portion of the space, the shielding plate 520 may stably maintain its coupled state.

The first plate protrusion portion 560*a* and the second plate protrusion portion 560*b* may include a first protruding surface 561, a second protruding surface 562, and a third protruding surface 563, respectively.

The first protruding surface 561 may extend from the plate outer circumferential portion 529 at a predetermined angle with respect to the plate outer circumferential portion 529. In one embodiment, the first protruding surface 561 may extend perpendicular to the plate outer circumferential portion 529.

The second protruding surface 562 may extend from the first protruding surface 561 at a predetermined angle with respect to the first protruding surface 561. In one embodiment, the second protruding surface 562 may extend perpendicular to the first protruding surface 561. Further, the second protruding surface 562 may extend parallel to the plate outer circumferential portion 529.

The third protruding surface 563 may extend from the second protruding surface 562 at a predetermined angle with respect to the second protruding surface 562. In one embodiment, the third protruding surface 563 may extend perpendicular to the second protruding surface 562. In addition, the third protruding surface 563 may extend parallel to the first protruding surface 561.

Another side of the second protruding surface 562, namely, a side opposite to the second protruding surface 562 may extend to the plate outer circumferential portion 529.

The plate protrusion portion 560 may have a shape that may increase the surface area of the plate outer circumferential portion 529 and a contact area with the inner circumferential portion 511*b*.

(7) Description of the Uneven Portion 570

Figure 8:
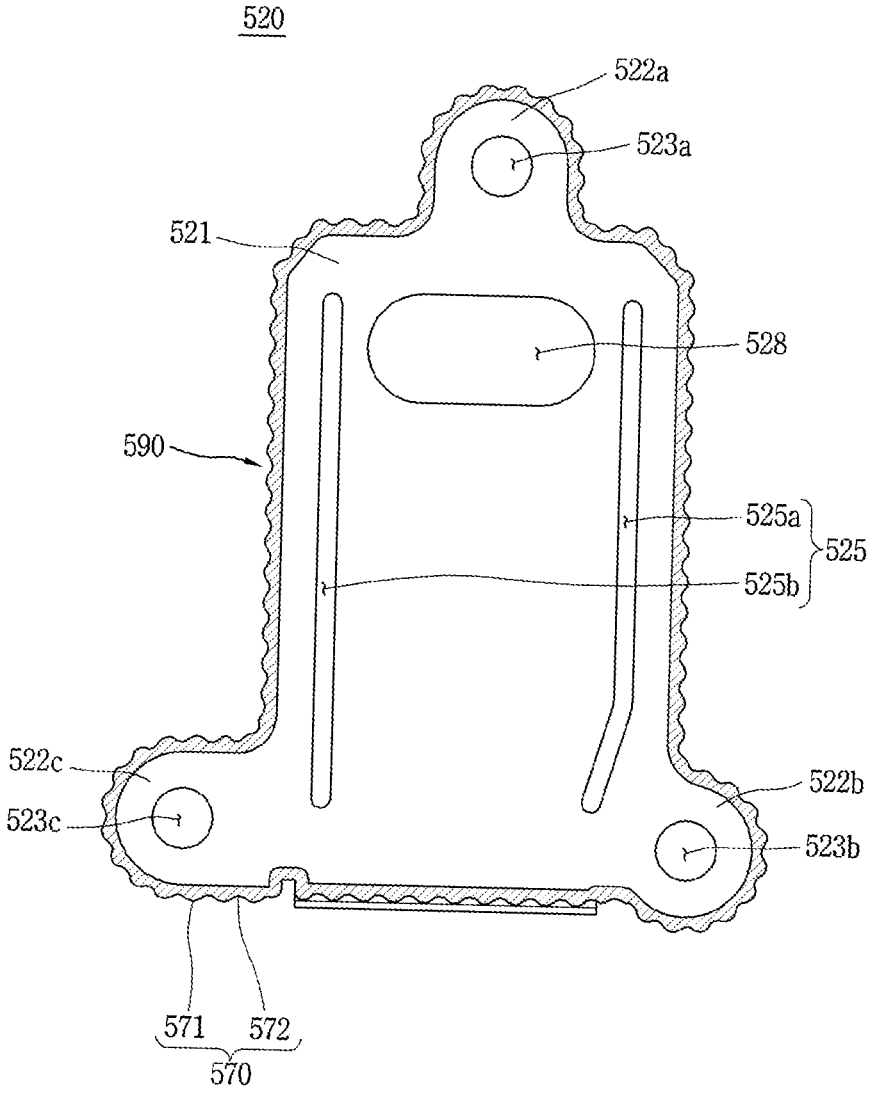
FIG. 8 is a cross-sectional view of a high-voltage connector assembly according to yet another embodiment of the present disclosure.
Figure 9:
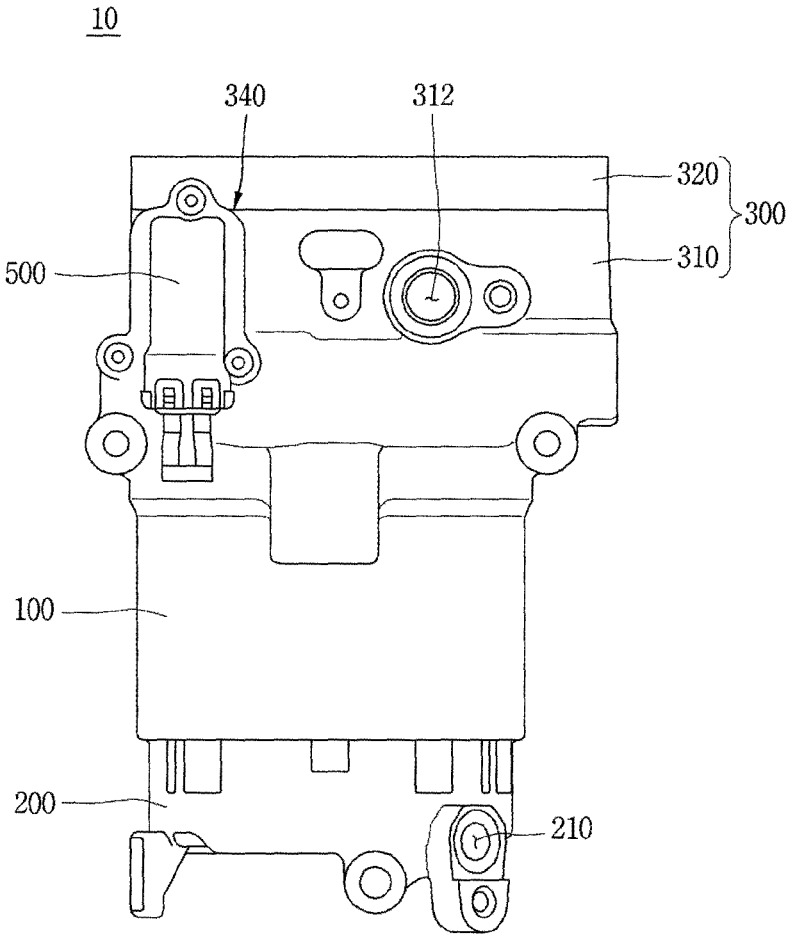
FIG. 9 is a lateral view illustrating a state in which a high-voltage connector assembly according to an embodiment of the present disclosure is coupled to a motor-operated compressor.

Referring to FIG. 8, the high-voltage connector assembly 500 according to an embodiment of the present disclosure may include the uneven portion 570.

The uneven portion 570 may be configured to increase a surface area of the plate outer circumferential portion 529. Accordingly, a clearance caused by a difference in the coefficient of thermal expansion between the cover 510 and the shielding plate 520 may be minimized. Further, a coupling force between the cover 510 and the shielding plate 520 may be enhanced.

In addition, the uneven portion 570 may be configured to form a surface of the plate outer circumferential portion 529 in a more complicated manner. Accordingly, the coupling force between the cover 510 and the shielding plate 520 may be improved as compared when the surface of the plate outer circumferential portion 529 is formed on a single smooth surface.

The uneven portion 570 may allow the shielding plate 520 to stably maintain a shielded state of the opening portion 511*b* of the cover 510.

Thus, water or dust at the outside may not be introduced into the space portion 514 of the cover 510, so that the electrical connection between the high-voltage cable 20 and the electric connection portion 410 may be stably maintained.

The uneven portion 570 may be formed at the plate outer circumferential portion 529. In detail, the uneven portion 570 may be sequentially formed along the plate outer circumferential portion 529.

The uneven portion 570 may include a convex portion 571 and a concave portion 572.

The convex portion 571 may protrude from the plate outer circumferential portion 529 by a predetermined distance. The concave portion 572 may be recessed from the plate outer circumferential portion 529 by a predetermined distance. The convex portion 571 and the concave portion 572 may be alternately formed along the plate outer circumferential portion 529 in a sequential or continuous manner.

In the illustrated embodiment, the convex portion 571 and the concave portion 572 may have a semicircular cross section, respectively. The convex portion 571 and the concave portion 572 may have a shape suitable for achieving the above-described aspects.

4. Description of Coupling Structure of High-Voltage Connector Assembly 500 and Motor-Operated Compressor 10 According to Embodiment Hereinafter, a coupling structure of the high-voltage connector assembly 500 and the motor-operated compressor 10 according to an embodiment will be described in detail with reference to FIGS. 9 to 11. As described above, the high-voltage connector assembly 500 may be coupled to the front housing 300.

In detail, the high-voltage connector assembly 500 may be coupled to the connector coupling portion 330 of the front housing 300. The filter accommodating portion 340 may be provided at a space surrounded by the connector coupling portion 330 to be recessed by a predetermined distance.

First, the EMC filter 400 may be inserted into the filter accommodating portion 340. The EMC filter 400 accommodated in the filter accommodating portion 340 may be electrically connected to the inverter device (not shown).

When the EMC filter 400 is inserted into the filter accommodating portion 340, one end of the electric connection portion 410 may protrude to the outside. The end of the electric connection portion 410 and the high-voltage cable 20 may be electrically connected to each other.

The high-voltage cable 20 may be coupled to the high-voltage connector assembly 500. In detail, the high-voltage cable 20 may be inserted into the holder through hole 552, the cable insertion hole 542, and the cable through hole 532 in order.

The high-voltage cable 20 may be inserted into the high-voltage connector assembly 500 until one end thereof reaches the EMC accommodating portion 518.

Although not shown, the one end of the high-voltage cable 20 may be provided with an electrically conductive member made of a conducting material. The electrically conductive member may be electrically connected to the electric connection portion 410. In one embodiment, the electrically conductive member may have a hollow portion therein so that the electric connection portion 410 is insertedly coupled to be electrically connected.

Then, the high-voltage connector assembly 500 may be coupled to the front housing 300.

One end of the electric connection portion 410 may penetrate through the EMC penetrating portion 528, so as to be accommodated in the EMC accommodating portion 518. At this time, the electrically conductive member of the high-voltage cable 20 may be positioned at the EMC accommodating portion 518. Thus, one end of the electric connection portion 410 and the electrically conductive member of the high-voltage cable 20 may be electrically connected to each other. In one embodiment, the electric connection portion 410 may be insertedly coupled to the electrically conductive member to be electrically connected.

Then, the high-voltage connector assembly 500 may be coupled to the front housing 300 by a coupling member (not shown).

In detail, the coupling member (not shown) may be coupled to the cover coupling holes 513*a*, 513*b*, and 513*c*, respectively, formed in the cover 510, and the shielding plate coupling holes 523*a*, 523*b*, and 523*c*, respectively, formed in the shielding plate 520.

One end of the coupling member (not shown) facing the front housing 300 may be insertedly coupled to a recessed portion (not shown) formed at the connector coupling portion 330. In one embodiment, the coupling member (not shown) may be configured as a screw member. In addition, a screw thread may be formed on an inner circumferential surface of the recessed portion (not shown).

5. Description of Effects of High-Voltage Connector Assembly 500 and Motor-Operated Compressor 10 According to Embodiments The cover 510 and the shielding plate 520 of the high-voltage connector assembly 500 according to the embodiments described herein may be integrally formed. In one embodiment, the cover 510 and the shielding plate 520 may be formed by double shot molding or insert injection molding.

Accordingly, manufacturing time and costs may be reduced as compared when manufacturing the cover 510 and the shielding plate 520 separately to be coupled to each other. In addition, a manufacturing process may be simplified as the cover 510 and the shielding plate 520, which have been produced manually, are integrally formed.

Further, the shielding plate 520 may not be moved or shaken while being coupled to the cover 510. Accordingly, the shielding plate 520 may be maintained at its optimal position for shielding an electrical noise signal generated in the EMC filter 400, thereby improving an effect of shielding the electrical noise signal.

Other components of the high-voltage connector assembly 500, such as the support plate 530 and the sealing part 540, are insertedly coupled to the cover 510. In addition, as the holder 550 is coupled to the cover 510, the members may be securely inserted.

Accordingly, no separate (or additional) coupling member is required to manufacture the high-voltage connector assembly 500. As a result, the number of members constituting the high-voltage connector assembly 500 may be reduced. In addition, since the coupling member is unnecessary, a clearance (or gap) that might be generated in a coupled area or portion is not created.

The cover 510 and the holder 550 may be coupled to each other in a snap-fit manner. That is, no separate coupling member is required to couple the cover 510 and the holder 550 to each other.

Thus, the cover 510 and the holder 550 may be coupled to each other in an easier manner. In addition, as the coupling member is excluded, no clearance that might be generated in a coupled portion is not created. Further, the snap-fitting may allow the cover 510 and the holder 550 to be securely coupled to each other, and thus they may not be separated from each other unless an external force is applied.

In addition, a decrease in the number of members constituting the high-voltage connector assembly 500 means a decrease in the number of contact points between members.

Thus, a clearance that might be generated in a contact area between members may be reduced. In addition, vibration generated when the motor-operated compressor 10 is in operation, vibration or impact between members in contact with each other may be reduced. Accordingly, durability against vibration of the high-voltage connector assembly 500 may be improved.

In addition, in one embodiment, the plate outer circumferential portion 529 may have a relatively higher roughness than the inner circumferential portion 511*c* of the cover 510.

Accordingly, a frictional force between the plate outer circumferential portion 529 and the inner circumferential portion 511*c* may be increased, so that the shielding plate 520 and the cover 510 are securely coupled to each other. Therefore, even when the shielding plate 520 and the cover 510 are thermally expanded in different volumes, a distance between the plate outer circumferential portion 529 and the inner circumferential portion 511*c* may be minimized. As a result, a space vulnerable to electric current leakage or water leakage may be minimized.

Also, in another embodiment, a plurality of plate protrusion portions 560 may be provided at the plate outer circumferential portion 529. The plurality of plate protrusion portions 560 may be spaced apart from one another by a predetermined distance along the plate outer circumferential portion 529.

Thus, a contact area between the plate outer circumferential portion 529 and the inner circumferential portion 511*c* may be increased. As a result, a contact force between the shielding plate 520 and the cover 510 may be enhanced, accordingly.

In addition, an increase in volume due to thermal expansivity of the cover 510 and the shielding plate 520 is compensated by a space generated when the plurality of plate protrusion portions 560 are spaced apart from one another.

As a result, a size of the space created by disposing the cover 510 and the shielding plate 520 to be spaced apart from each other may be minimized. Accordingly, electric current leakage or water leakage that may occur through the space may be minimized.

In addition, in another embodiment, the uneven portion 570 may be provided at the plate outer circumferential portion 529. The uneven portion 570 is formed such that the convex portion 571 and the concave portion 572 are alternately provided, and sequentially formed along the plate outer circumferential portion 529.

Therefore, a contact area between the plate outer circumferential portion 529 and the inner circumferential portion 511*c* may be increased, thereby enhancing a contact force between the shielding plate 520 and the cover 510.

In addition, an increase in volume due to thermal expansivity of the cover 510 and the shielding plate 520 may be compensated by the concave portion 572.

As a result, the size of the space created by disposing the cover 510 and the shielding plate 520 to be spaced apart from each other may be minimized. Accordingly, electric current leakage or water leakage that might occur through the space may be minimized.

Although embodiments have been described with reference to a number of illustrative embodiments thereof, it should be understood that numerous other modifications and embodiments can be devised by those skilled in the art that will fall within the spirit and scope of the principles of this disclosure.

What is claimed is:

1. A high-voltage connector assembly, comprising:

a cover comprising an opening portion formed on a first side of the cover and a space portion communicating with the opening portion;

a shielding plate disposed inside the cover and integrally formed with the cover, the shielding plate being configured to cover the opening portion and to shield noise generated in an Electromagnetic Compatibility (EMC) filter;

a support plate located adjacent to the cover and configured to support a high-voltage cable inserted into the cover;

a sealing part located adjacent to the support plate and configured to surround the inserted high-voltage cable; and a holder coupled to the cover to hermetically seal an inside of the cover, the holder being detachably coupled to a second side of the cover, wherein:

the second side of the cover is provided with a boss portion protruding by a first predetermined distance;

the boss portion comprises a cable insertion portion communicating with the space portion and configured to be opened so as to allow the high-voltage cable to be inserted;

the holder is coupled to the cover to cover the cable insertion portion;

the boss portion includes a holder coupling protrusion that protrudes from an outer surface of the boss portion by a second predetermined distance;

the holder comprises:

a cover coupling portion protruding in a lengthwise direction by a third predetermined distance; and a cover insertion hole formed though the cover coupling portion at a predetermined angle with respect to the lengthwise direction of the cover coupling portion; and the holder coupling protrusion is inserted into the cover insertion hole in manner of snap-fit when the holder is coupled to the cover.

2. The high-voltage connector assembly of claim 1, wherein:

the cover is made of an insulating material;

the shielding plate is made of a conductive material; and the cover and the shielding plate are formed by double shot molding.

3. The high-voltage connector assembly of claim 2, wherein the cover is made of a synthetic resin material and the shielding plate is made of a brass material.

4. The high-voltage connector assembly of claim 1, wherein the shielding plate comprises a plate outer circumferential portion configured to contact an inner circumferential portion of the cover and defining an outer circumference of the shielding plate; and wherein the plate outer circumferential portion has a higher roughness than the inner circumferential portion of the cover.

5. The high-voltage connector assembly of claim 1, wherein the shielding plate comprises a plate outer circumferential portion configured to contact an inner circumferential portion of the cover and defining an outer circumference of the shielding plate; and wherein the plate outer circumferential portion comprises a plate protrusion protruding from the plate outer circumferential portion configured to increase a surface area.

6. The high-voltage connector assembly of claim 5, wherein the plate outer circumferential portion comprises a plurality of plate protrusions spaced apart from one another by a fourth predetermined distance.

7. The high-voltage connector assembly of claim 1, wherein the shielding plate comprises a plate outer circumferential portion configured to contact an inner circumferential portion of the cover and defining an outer circumference of the shielding plate; and wherein a surface of the outer circumferential portion is provided with a plurality of uneven portions configured to increase a surface area.

8. A motor-operated compressor, comprising:

a main housing configured to accommodate a motor and a compression unit;

a front housing communicating with the main housing, the front housing having an inlet port formed through one side of the front housing, the inlet port being configured to introduce a refrigerant into the main housing; and a high-voltage connector assembly coupled to the front housing, the high-voltage connector assembly being configured to support a high-voltage cable electrically connected to an external controller, wherein the high-voltage connector assembly comprises:

a cover comprising an opening portion formed on a first side of the cover and a space portion communicating with the opening portion;

a shielding plate disposed inside the cover and integrally formed with the cover, the shielding plate being configured to cover the opening portion and to shield noise generated in an Electromagnetic Compatibility (EMC) filter;

a support plate located adjacent to the cover and configured to support the high-voltage cable when inserted into the cover;

a sealing part located adjacent to the support plate and configured to surround the inserted high-voltage cable; and a holder coupled to the cover to hermetically seal an inside of the cover, the holder being detachably coupled to a second side of the cover, wherein:

the second side of the cover is provided with a boss portion protruding by a first predetermined distance;

the boss portion comprises a cable insertion portion communicating with the space portion and configured to be opened so as to allow the high-voltage cable to be inserted;

the holder is coupled to the cover to cover the cable insertion portion;

the boss portion includes a holder coupling protrusion that protrudes from an outer surface of the boss portion by a second predetermined distance;

the holder comprises:

a cover coupling portion protruding in a lengthwise direction by a third predetermined distance; and a cover insertion hole formed though the cover coupling portion at a predetermined angle with respect to the lengthwise direction of the cover coupling portion; and the holder coupling protrusion is inserted into the cover insertion hole in manner of snap-fit when the holder is coupled to the cover.

9. The motor-operated compressor of claim 8, wherein the shielding plate comprises a plate outer circumferential portion configured to contact an inner circumferential portion of the cover and defining an outer circumference of the shielding plate; and wherein the plate outer circumferential portion is provided with at least one of a plate protrusion or a plurality of uneven portions.

10. A high-voltage connector assembly, comprising:

a cover comprising:

an opening portion formed on a first side of the cover;

a space portion communicating with the opening portion; and an Electromagnetic Compatibility (EMC) accommodating portion configured to receive an electrical connection portion of an EMC filter;

a shielding plate disposed inside the cover, the shielding plate comprising an EMC penetrating portion configured to align with the EMC accommodating portion; and a holder coupled to the cover to hermetically seal an inside of the cover, the holder being detachably coupled to a second side of the cover;

wherein:

the second side of the cover is provided with a boss portion protruding by a first predetermined distance;

the boss portion comprises a cable insertion portion communicating with the space portion and configured to be opened so as to allow a high-voltage cable to be inserted;

the holder is coupled to the cover to cover the cable insertion portion;

the boss portion includes a holder coupling protrusion that protrudes from an outer surface of the boss portion by a second predetermined distance:

the holder comprises:

a cover coupling portion protruding in a lengthwise direction by a third predetermined distance; and a cover insertion hole formed though the cover coupling portion at a predetermined angle with respect to the lengthwise direction of the cover coupling portion; and the holder coupling protrusion is inserted into the cover insertion hole in manner of snap-fit when the holder is coupled to the cover.

11. The high-voltage connector assembly of claim 10, wherein:

the cover is made of an insulating material;

the shielding plate is made of a conductive material; and the cover and the shielding plate are integrally formed by double shot molding.

12. A high-voltage connector assembly, comprising:

a cover comprising:

an opening portion formed on a first side of the cover;

a space portion communicating with the opening portion;

an inner circumferential portion; and a holder coupling protrusion that protrudes from an outer surface of the cover; and a shielding plate disposed inside the cover and configured to receive an electrical connection portion of Electromagnetic Compatibility (EMC) filter, the shielding plate comprising a plate outer circumferential portion configured to contact the inner circumferential portion and defining an outer circumference of the shielding plate; and a holder coupled to the cover to hermetically seal an inside of the cover, the holder being detachably coupled to a second side of the cover, wherein the holder comprises:

a cover coupling portion protruding in a lengthwise direction by a first predetermined distance; and a cover insertion hole formed though the cover coupling portion at a predetermined angle with respect to the lengthwise direction of the cover coupling portion; and wherein the holder coupling protrusion is inserted into the cover insertion hole in snap-fit manner when the holder is coupled to the cover.

13. The high-voltage connector assembly of claim 12, wherein the plate outer circumferential portion has a higher roughness than the inner circumferential portion of the cover.

14. The high-voltage connector assembly of claim 12, wherein the plate outer circumferential portion is provided with at least one of a plate protrusion or a plurality of uneven portions.

* * * * *